US006317576B1

(12) United States Patent
Ishida et al.

(10) Patent No.: US 6,317,576 B1
(45) Date of Patent: Nov. 13, 2001

(54) ELECTROPHOTOGRAPHIC DEVELOPING UNIT

(75) Inventors: Toshihisa Ishida, Kashiba; Hitoshi Nagahama, Uji; Katsuaki Sumida, Kashiba; Takahiro Bito, Nara; Keizo Kitamura, Yamatokoriyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/488,645

(22) Filed: Jan. 21, 2000

(30) Foreign Application Priority Data

Jan. 22, 1999 (JP) ..... 11-014045

(51) Int. Cl.[7] ..... G03G 15/09
(52) U.S. Cl. ..... 399/273; 399/267
(58) Field of Search ..... 399/119, 264, 399/265, 267, 272, 273, 275, 277, 104

(56) References Cited

U.S. PATENT DOCUMENTS 4,559,899 * 12/1985 Kan et al. ..... 399/104
4,671,641 * 6/1987 Kohyama ..... 399/264
4,676,191 * 6/1987 Kojima et al. ..... 399/104
4,705,383 * 11/1987 Hiraga et al. ..... 399/275
4,774,543 * 9/1988 Yoshikawa et al. ..... 399/267 X
5,768,666 * 6/1998 Ito et al. ..... 399/273
5,826,136 10/1998 Saiko et al. .
5,839,018 11/1998 Asanuma et al. .

FOREIGN PATENT DOCUMENTS

6194962 A 7/1994 (JP) .

* cited by examiner

*Primary Examiner*—Sandra Brase

(57) ABSTRACT

A magnetic member is arranged at a position on the downstream side with respect to the rotational direction of a developing sleeve, outside the developer conveyance path where the magnetism from the magnetic member has no influence on the magnetic field of the developing magnetic pole. When the magnetic member is arranged with its N pole facing the developing sleeve, the magnetic attractive force from the magnetic member weakens the developer's attraction to the peripheral surface of the developing sleeve. When the magnetic member is arranged with its S pole facing the developing sleeve, the developer being conveyed along the developer conveyance path is magnetized in such a direction as to repel the peripheral surface of the developing sleeve. In either case, the adhering state of the developer to the peripheral surface of the developing sleeve having passed through the developing position is unstable, so that the developer having adhered to the developing sleeve will easily drop off from the developing sleeve after passage of the developing position.

12 Claims, 13 Drawing Sheets

FIG.22

| | IMAGE DENSITY | FOG DENSITY | DEVELOPER CIRCULATION EVALUATION (TONER CONCENTRATION %) | | | | TONER AGGRE-GATION | TONER FILMING OVER DEVELOPER SLEEVE | TONER FILMING OVER CARRIER SURFACE | ADHERENCE OF EXTERNAL ADDITIVES OVER TONER SURFACE | TOTAL EVALUATION |
|---|---|---|---|---|---|---|---|---|---|---|---|
| | | | DEVELOPER SLEEVE SURFACE A | AGITATED PORTION B | | EVALU-ATION | | | | | |
| EXAMPLE 1 | 1.46-1.41 | 0.31-0.10 | 7.1 | 7.3 | -0.2 | GOOD | GOOD | GOOD | GOOD | GOOD | GOOD |
| EXAMPLE 2 | 1.43-1.39 | 0.25-0.10 | 7.0 | 7.0 | 0.0 | GOOD | GOOD | GOOD | GOOD | GOOD | GOOD |
| EXAMPLE 3 | 1.42-1.39 | 0.45-0.17 | 6.8 | 6.9 | -0.1 | GOOD | GOOD | GOOD | GOOD | GOOD | GOOD |
| EXAMPLE 4 | 1.44-1.38 | 0.43-0.27 | 6.7 | 6.9 | -0.2 | GOOD | GOOD | GOOD | GOOD | GOOD | GOOD |
| EXAMPLE 5 | 1.45-1.40 | 0.20-0.05 | 7.0 | 7.0 | 0.0 | GOOD | GOOD | GOOD | GOOD | GOOD | GOOD |
| EXAMPLE 6 | 1.43-1.40 | 0.22-0.10 | 6.9 | 6.9 | 0.0 | GOOD | GOOD | GOOD | GOOD | GOOD | GOOD |
| EXAMPLE 7 | 1.43-1.39 | 0.38-0.18 | 6.5 | 6.9 | -0.4 | GOOD | GOOD | GOOD | GOOD | GOOD | GOOD |
| EXAMPLE 8 | 1.41-1.38 | 0.47-0.20 | 6.7 | 6.9 | -0.2 | GOOD | GOOD | GOOD | GOOD | GOOD | GOOD |
| EXAMPLE 9 | 1.46-1.42 | 0.19-0.10 | 7.0 | 7.2 | -0.2 | GOOD | GOOD | GOOD | GOOD | GOOD | GOOD |
| EXAMPLE 10 | 1.42-1.37 | 0.23-0.08 | 6.9 | 7.0 | -0.1 | GOOD | GOOD | GOOD | GOOD | GOOD | GOOD |
| EXAMPLE 11 | 1.43-1.37 | 0.40-0.20 | 7.0 | 7.1 | -0.1 | GOOD | GOOD | GOOD | GOOD | GOOD | GOOD |
| EXAMPLE 12 | 1.44-1.39 | 0.33-0.22 | 6.9 | 6.9 | -0.0 | GOOD | GOOD | GOOD | GOOD | GOOD | GOOD |
| EXAMPLE 13 | 1.45-1.43 | 0.32-0.10 | 6.9 | 7.0 | -0.1 | GOOD | GOOD | GOOD | GOOD | GOOD | GOOD |
| EXAMPLE 14 | 1.43-1.39 | 0.28-0.15 | 6.9 | 6.9 | 0.0 | GOOD | GOOD | GOOD | GOOD | GOOD | GOOD |
| EXAMPLE 15 | 1.43-1.41 | 0.48-0.19 | 6.4 | 6.6 | -0.2 | GOOD | GOOD | GOOD | GOOD | GOOD | GOOD |
| EXAMPLE 16 | 1.42-1.38 | 0.47-0.25 | 6.7 | 6.9 | -0.2 | GOOD | GOOD | GOOD | GOOD | GOOD | GOOD |
| EXAMPLE 17 | 1.42-1.39 | 0.42-0.21 | 6.5 | 6.8 | -0.3 | GOOD | GOOD | GOOD | GOOD | GOOD | GOOD |
| COMP.EX.1 | 1.00-0.72 | 1.20-0.98 | 5.8 | 6.9 | -1.1 | BAD | BAD | MEDIUM | BAD | MEDIUM | BAD |
| COMP.EX.2 | 0.85-058 | 1.02-0.76 | 6.2 | 7.0 | -0.8 | MEDIUM | MEDIUM | MEDIUM | MEDIUM | MEDIUM | MEDIUM |
| COMP.EX.3 | 1.43-1.40 | 1.45-1.23 | 4.9 | 7.0 | -2.1 | BAD | BAD | BAD | BAD | BAD | BAD |

★ EVALUATION CRITERIA 1.35≦ALLOWABLE IMAGE DENSITY, 0.50≧ALLOWABLE FOG DENSITY
B-A : GOOD < 0.5 < MEDIUM < 1.0 < BAD

ELECTROPHOTOGRAPHIC DEVELOPING UNIT

BACKGROUND OF THE INVENTION (1) Field of the Invention

The present invention relates to a developing unit which is used in an image forming apparatus for forming images based on electrophotography and which develops a static latent image into a developed image by supplying the developer to the photosensitive member by way of a developer support having a developer magnetically attracted to the peripheral surface thereof.

(2) Description of the Prior Art

An image forming apparatus for forming images based on electrophotography has a developing unit which supplies a developer to the surface of the photosensitive member after it has been exposed to light of an image. The developer supplied from the developing unit develops the static latent image which has been formed on the surface of the photosensitive member by the photo-conducting effect into a developer image. For example, a typical developing unit which develops the static latent image using a dual-component developer consisting of a toner powder of thermoplastic resin and a magnetic carrier powder is comprised of a cylindrical developing sleeve that incorporates fixed magnets and rotates opposing the surface of the photosensitive member and an agitator for agitating the dual component developer stored therein.

Inside the developing unit, the toner which has been agitated by the agitator electrostatically adheres to the surface of the carrier while the carrier having the toner electrostatically adhering on the surface thereof is mainly magnetically attracted to the surface of the developing sleeve under the magnetic fields of the fixed magnets. The carrier attracting the toner thereon is conveyed by the rotation of the developing sleeve to the developing position where the sleeve opposes the surface of photosensitive member. When the toner on the surface of the developing sleeve faces the static latent image on the surface of the photosensitive member, it transfers from the carrier to the static latent image on the surface of the photosensitive member while the carrier alone remains attracted to the surface of the developing sleeve and returns into the developing unit. Accordingly, the adherence of the toner becomes irregular in the axial direction of the developing sleeve after the sleeve has passed by the surface of the photosensitive member. If this situation is left as it is, it will produce density unevenness in the image causing degradation of image quality in subsequent image formation.

In general, in a developing unit, two magnetic poles of a like polarity are arranged adjacent to each other as the fixed magnets incorporated inside the developing sleeve, on the downstream side of the developing position with respect to the rotational direction of the developing sleeve so that a repulsive magnetic field may be generated between these two magnetic poles to temporarily remove the dual-component developer from the developing sleeve. Then the dual-component developer thus removed from the developing sleeve is agitated by an agitator arranged in the repulsive magnetic field to make the toner concentration uniform, in the axial direction of the developing sleeve. Thereafter the dual-component developer is re-attracted to the surface of the developing sleeve by the magnetic pole which is positioned on the more downstream side.

However, it is difficult to completely remove the dual-component developer from the surface of the developing sleeve by only the action of the repulsive magnetic field which is generated by the fixed magnets inserted within the developing sleeve, so some part of the dual-component developer having passed through the developing position cannot be removed from the surface of the developing sleeve and may be conveyed again to the developing position for the subsequent image formation. In such a case, it is impossible to completely negate image density unevenness due to irregularity of the toner concentration. A dual-component developer adheres to the surface of the developing sleeve not only by magnetic attraction but also by electrostatic attraction. For example, if a dual-component developer is composed of a small-sized toner having a mean particle diameter of about 4 to 10 $\mu$m and a small-sized carrier having a mean particle diameter of about 20 to 50 $\mu$m, the static charge per unit weight of the toner or the carrier becomes relatively high so that the electrostatic attraction of the developer to the surface of the developing sleeve becomes stronger, thus further making it difficult to remove the dual-component developer from the surface of the developing sleeve.

When as in the above way the dual-component developer having passed through the developing position cannot be removed from the developing sleeve and is repeatedly used for image formation, it is impossible to avoid degradation of image quality due to image density unevenness. In particular, the reproducibility of the image during image formation at a high resolution using a micro-toner will be deteriorated. Further, the carrier which has remained attracted to the surface of the developing sleeve and hence has continuously received mechanical loads, so that the dual-component developer becomes degraded at an early stage, which poses problems of a further lowering of the image density and fogging in the image.

To deal with these problems, in a conventional developing unit, for example, Japanese Patent Application Laid-Open Hei 6 No.194962 has offered a configuration in which a magnetic member is arranged in the repulsive magnetic field formed by the fixed magnets within the conveyance path of the dual-component developer attracted to the surface of the developing sleeve so that it is magnetized by magnetic induction of the fixed magnets, whereby the dual-component developer is fully removed from the surface of the developer support by using a magnetic brush formed between the developer support and the magnetic member.

Another method has also been proposed in which a cleaning member is arranged so as to abut the surface of the developing sleeve in the repulsive magnetic field formed by the fixed magnets within the conveyance path of the dual-component developer attracted to the surface of the developing sleeve in order to mechanically remove the dual-component developer from the surface of the developing sleeve.

However, when a magnetic member or cleaning member is laid out in the conveyance path of the dual-component developer, they will hinder the normal flow state of the dual-component developer in the developing unit. So it becomes impossible to uniformly attract an adequate amount of the dual-component developer to the surface of the developing sleeve, thus defeating the object and contributing to disadvantages such as degradation of image quality, etc. In particular, in the configuration in which a cleaning member abutting the surface of the developing sleeve removes the dual-component developer from the surface of the developing sleeve, the dual-component toner receives heavy mechanical loads, which not only causes toner aggregation and early degradation of the dual-component developer but also a considerable increase of the driving torque of the developing sleeve and/or frictional heat due to rubbing between the developing sleeve and the cleaning member.

Since in all the conventional configurations it is assumed that a repulsive magnetic field generated by the fixed magnets inserted within the developing sleeve is used in order to remove the dual-component developer from the surface of the developing sleeve, if the developing sleeve is made smaller as to its diameter with the demand for making the image forming apparatus compact, high precision is needed for setting the polarizing positions of the fixed magnets, resulting in increased cost.

These problems occur not only in developing units using a dual-component developer containing a toner and a carrier but also in a developing unit which magnetically holds a mono-component developer of a magnetic toner on a developer support and supplies the photosensitive member with it.

SUMMARY OF THE INVENTION

It is therefore an object of the present invention to provide a developing unit which can fully remove the developer from the surface of the developing sleeve without the necessity of using any repulsive magnetic field generated by fixed magnets incorporated in the developing sleeve and without the necessity of any magnetic member or cleaning member arranged in the conveying path of the developer and which can prevent degradation of image quality due to unevenness of the amount of the toner adhering to the surface of the developing sleeve, without a marked increase in cost.

In order to achieve the above object, the present invention is configured as follows:

In accordance with the first feature of the invention, a developing unit comprises: a rotational, cylindrical developer support which is axially supported at a position opposing the photosensitive member surface and has magnetic fields at plural predetermined positions with respect to the rotational direction thereof in such a manner that spikes made of developer are formed on the developing position of the developer support surface so as to be brought into contact with the photosensitive member and are not formed on the upstream side and downstream side of the developing position of the developer support surface with respect to the rotational direction thereof; and a magnetic member arranged at a position opposing the developer conveyance path that is formed by the developer support, on the downstream side of the developing position whilst being kept away from the developer in the developer conveyance path.

In accordance with the second feature of the invention, the developing unit having the above first feature is characterized in that the magnetic member has, at least, a pair of dissimilar magnetic poles arranged in the rotational direction of the developer support.

In accordance with the third feature of the invention, the developing unit having the above first feature is characterized in that the magnetic member is configured of an electromagnet, further comprising a current control circuit for switching the current direction to the electromagnet.

In accordance with the fourth feature of the invention, the developing unit having the above third feature is characterized in that the magnetic member is configured of a plurality of electromagnets arranged in the rotational direction of the developer support.

In accordance with the fifth feature of the invention, the developing unit having the above fourth feature is characterized in that the magnetic member is configured of a plurality of electromagnets producing magnetic fields of alternately, dissimilar polities.

In accordance with the sixth feature of the invention, the developing unit having the above fifth feature is characterized in that the plural electromagnets are configured of coils of alternating and opposite winding directions.

In accordance with the seventh feature of the invention, the developing unit having the above third through sixth features is characterized in that the current control circuit varies the current or currents to a single or a plurality of electromagnets in direction or quantity, in accordance with the developer's conditions.

In accordance with the eighth feature of the invention, the developing unit having the above first feature is characterized in that the magnetic member periodically changes its polarity of the magnetic field opposing the peripheral surface of the developer support.

In accordance with the ninth feature of the invention, the developing unit having the above eighth feature is characterized in that the magnetic member is of a rotational body having a magnetic pole or poles disposed in part on the peripheral surface thereof and is arranged in parallel with the developer support.

In accordance with the tenth feature of the invention, the developing unit having the above eighth feature is characterized in that the magnetic member is of a rotational body having a plurality of magnetic poles arranged at regular intervals in the direction of the circumference on the peripheral surface thereof.

In accordance with the eleventh feature of the invention, the developing unit having the above tenth feature is characterized in that the magnetic member is of a rotational body having a plurality of dissimilar, magnetic poles arranged alternately with respect to direction of the circumference on the peripheral surface thereof.

In the invention defined in the first feature, a magnetic member is arranged at a position opposing the developer conveyance path that is formed by the developer support, on the downstream side of the developing position with respect to the rotational direction of the developer support whilst being kept away from the developer in the developer conveyance path. Therefore, the developer residing in the developer conveyance path on the downstream side of the developing position with respect to the rotational direction of the developer support can be magnetized by the magnetism of the magnetic member in such a direction that the developer is attracted to the magnetic member side or in such a direction that the developer tends to repel the developer support, thus weakening the attraction of the developer to the peripheral surface of the developer support. In this case, no mechanical stress from the magnetic member is applied on the developer adhering to the peripheral surface of the developer support.

In the invention defined in the second feature, a magnetic member is arranged at a position on the downstream side of the developing position with respect to the rotational direction of the developer support and opposing the magnetic field of the developer support whilst being kept away from the developer in the developer conveyance path. Accordingly, the magnetic fields of the magnetic pieces magnetize the developer adhering to the peripheral surface of the rotating developer support in a manner that causes the developer to be attracted to the magnetic member side or to repel the developer support, thus weakening the attraction of the developer to the peripheral surface of the developer support.

In the invention defined in the third feature, an electromagnet of which the direction of the current can be switched by the current control circuit is arranged at a position on the downstream side of the developing position with respect to the rotational direction of the developer support and opposing the magnetic field of the developer support. Accordingly, the developer adhering to the peripheral surface of the rotating developer support is magnetized in an alternating manner every time the direction of the current from the current control circuit is switched in such a manner causes the developer to be attracted to the magnetic member side or to repel the developer support. Therefore, there is no need to arrange a plural number of magnetic elements in order to weaken the attraction of the developer to the peripheral surface of the developer support, thus making the Layout space for the magnetic element compact.

In the invention defined in the fourth feature, a multiple number of electromagnets are arranged at positions on the downstream side of the developing position with respect to the rotational direction of the developer support and opposing the magnetic field of the developer support. Accordingly, by switching the directions of the currents to the plural number of electromagnets using the current control circuit, the developer adhering to a large area on the peripheral surface of the developer support is magnetized so that the developer is attracted to the magnetic member side and repels the developer support, thus weakening the attraction of the developer to the peripheral surface of the developer support in the large area of the developer conveyance path.

In the invention defined in the fifth feature, a plural number of electromagnets producing magnetic fields of alternately, dissimilar polities are arranged at positions on the downstream side of the developing position with respect to the rotational direction of the developer support and opposing the magnetic field of the developer support, in the rotational direction of the developer support. Accordingly, by switching the directions of the currents to the electromagnets using the current control circuit and also by rotating the developer support, the developer adhering to a large area on the peripheral surface of the rotating developer support is magnetized so that the developer is attracted to the magnetic member side and repels the developer support, thus weakening the attraction of the developer to the peripheral surface of the developer support in the large area of the developer conveyance path.

In the invention defined in the sixth feature, a plural number of electromagnets configured of coils of alternating and opposite winding directions are arranged at positions on the downstream side of the developing position with respect to the rotational direction of the developer support and opposing the magnetic field of the developer support, in the rotational direction of the developer support. Therefore, if adjacent electromagnets have the same current supplied in the same direction, a plurality of electromagnets create alternating polarities and hence adjacent electromagnets create magnetic fields of opposite polarities so that there is no need to individually switch the direction of current for each electromagnet thus reducing the number of current control circuitry.

In the invention defined in the seventh feature, the current to a single or each electromagnet that is arranged at a position on the downstream side of the developing position with respect to the rotational direction of the developer support and opposing the magnetic field of the developer support is varied in its direction or quantity in accordance with the used amount of the developer and/or the degraded level etc. As a result, it is possible for the electromagnets to magnetize the developer adhering to the peripheral surface of the developer support in a suitable manner that causes the developer to be attracted to the magnetic member and to repel the developer support, thus positively removing the developer from the peripheral surface of the developer support without imparting any excessive mechanical stress on the developer.

In the invention defined in the eighth feature, the polarity of the magnetic field on the downstream side of the developing position with respect to the rotational direction of the developer support and opposing the peripheral surface of the developer support is changed periodically. Therefore, the developer adhering on the peripheral surface of the developer support can be uniformly magnetized throughout the entire peripheral surface of the developer support in a manner that causes the developer adhering to the peripheral surface of the developer support to be attracted to the magnetic member side and to repel the developer support. As a result, no density unevenness will occur in resulting images.

In the invention defined in the ninth feature, a rotational body having a magnetic pole or poles in part on the peripheral surface thereof is arranged at a position on the downstream side of the developing position with respect to the rotational direction of the developer support and opposing the peripheral surface of the developer support. Accordingly, by rotating the rotational body at a fixed rate, the magnetic pole or poles formed in part of the peripheral surface of the rotational body is made to periodically oppose the peripheral surface of the developer support so as to magnetize the developer adhering to the peripheral surface of the developer support in a manner that cause the developer to be attracted to the magnetic member side or to repel the developer support, without the necessity of regulating the current at exactly controlled timings.

In the invention defined in the tenth feature, a rotational body having a plurality of magnetic poles arranged at regular intervals in the direction of the circumference on the peripheral surface thereof is arranged at a position on the downstream side of the developing position with respect to the rotational direction of the developer support. Accordingly, during one revolution of the rotational body, multiple magnetic poles oppose the peripheral surface of the developer support in a fixed cycle so as to magnetize the developer adhering to the peripheral surface of the developer support in such a direction as to be attracted to the magnetic member side or in such a direction as to repel the developer support, in a short period of time.

In the invention defined in the eleventh feature, a rotational body having a plurality of dissimilar, magnetic poles arranged alternately with respect to direction of the circumference on the peripheral surface thereof is arranged at a position on the downstream side of the developing position with respect to the rotational direction of the developer support so as to oppose the peripheral surface of the developer support. Accordingly, during one revolution of the rotational body, a plurality of magnetic poles of alternating polarities oppose the peripheral surface of the developer support so as to alternately magnetize the developer adhering to the peripheral surface of the developer support in such a direction as to be attracted to the magnetic member side and in such a direction as to repel the developer support, in a short period of time.

BRIEF DESCRIPTION OF THE DRAWINGS

FIG. 22 is a table showing the results of the image formation using the above first to seventeenth developing units;

DESCRIPTION OF THE PREFERRED EMBODIMENTS

Figure 1:
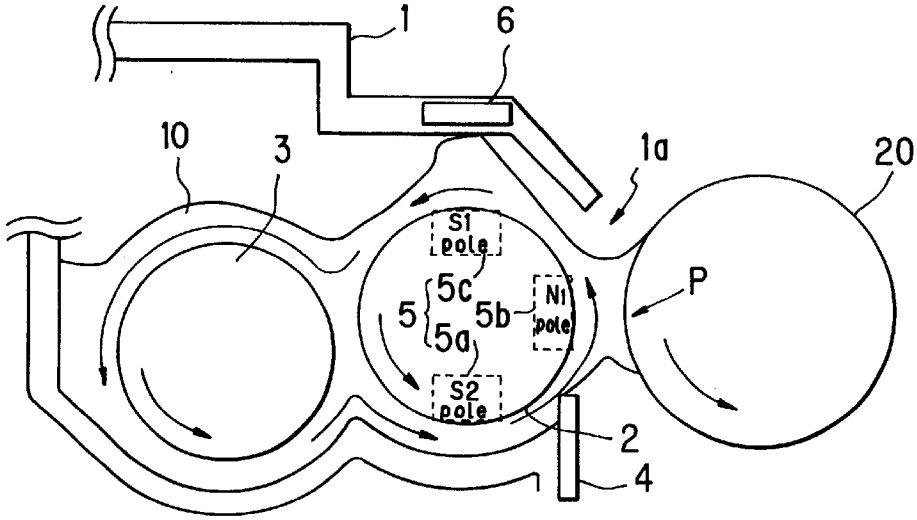
FIG. 1 is a sectional view showing a configuration of the first example of a developing unit in accordance with the embodiment of the invention.
Figure 2:
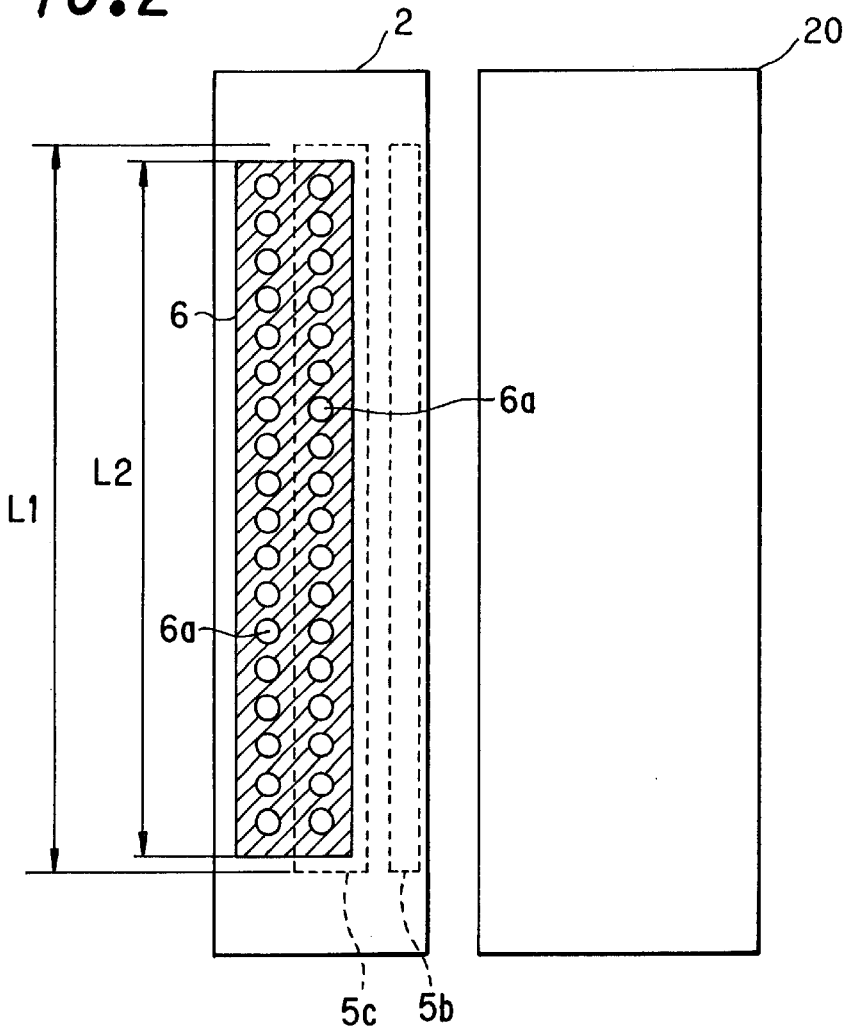
FIG. 2 is a partial plan view showing the configuration of the first example of the developing unit.
Figure 3:
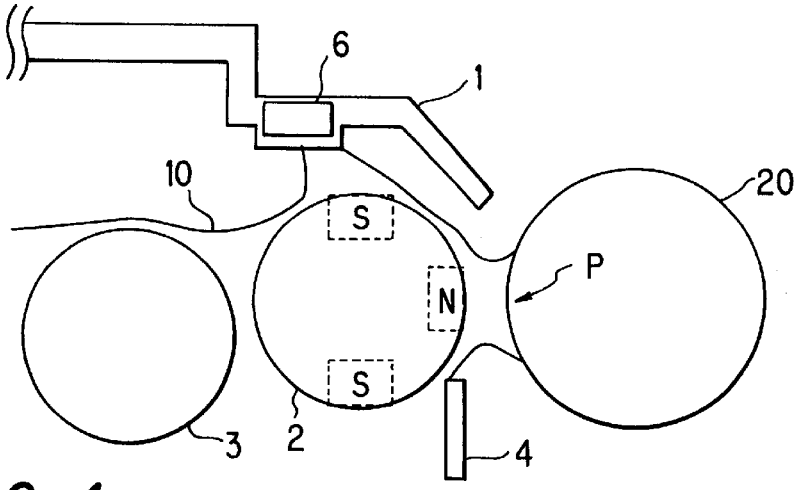
FIG. 3 is a sectional view showing the configuration of the second example of the developing unit.
Figure 4:
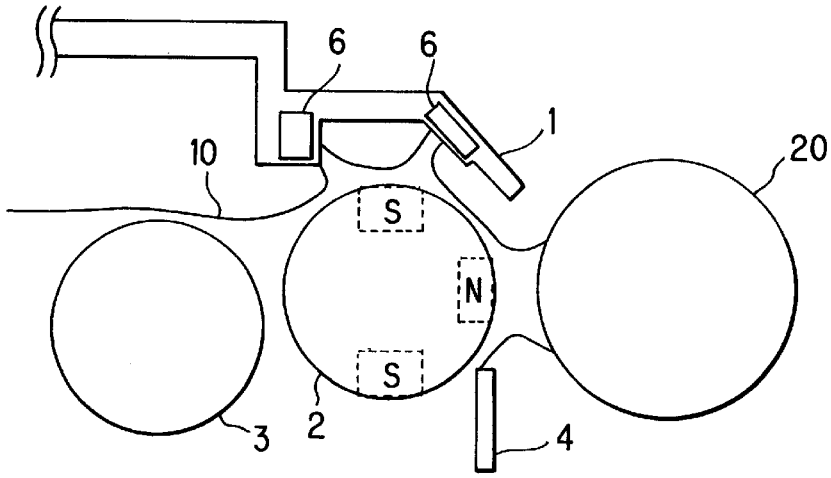
FIG. 4 is a sectional view showing the configuration of the third example of the developing unit.
Figure 5:
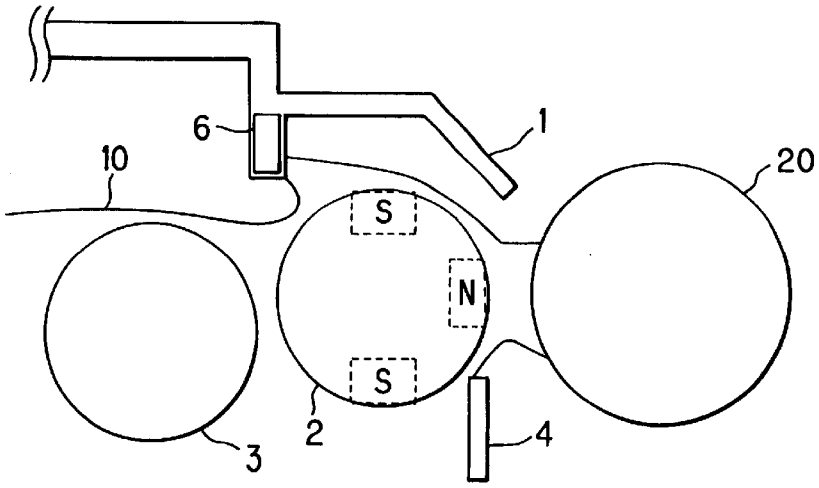
FIG. 5 is a sectional view showing the configuration of the fourth example of the developing unit.

FIGS. 1 and 2 are sectional and partial plan views showing a configuration of the first example of a developing unit in accordance with the embodiment of the invention. FIGS. 3 through 5 are sectional views showing the configurations of the second through fourth examples of the developing unit in accordance with the first embodiment of the invention. In the developing unit according to the first embodiment of the invention, a magnetic member formed of permanent magnets is arranged at a position opposing the downstream side of the developing position in the developer conveyance path formed by the developing sleeve whilst being kept away from the developer in the developer conveyance path formed by the developing sleeve.

Developing unit 1 of the first example is arranged opposing the peripheral surface of a photosensitive drum 20 for use in an image forming apparatus such as a copier etc. that effects image formation using the electrophotographic technique. Developing unit 1 stores a developer 10 made up of a toner power of thermoplastic resin and a carrier of a magnetic powder and has a developing sleeve 2 and an agitating roller 3 both axially supported in parallel with photosensitive drum 20. A rotational force acts upon these developing sleeve 2 and agitating roller 3 by means of an unillustrated transmission mechanism. Agitating roller 3 agitates developer 10 by its rotation. By this agitation, the toner and carrier making up developer 10 are triboelectrified so that the toner is electrostatically attracted to the carrier surface.

Developing sleeve 2 as the developer support of this invention is arranged so that part of the peripheral surface thereof is exposed through an opening 1*a* of developing unit 1 and opposes the peripheral surface of photosensitive drum 20. Developing sleeve 2 is a hollow cylinder which incorporates a fixed magnet member 5 made up of a conveying pole 5*a*(S pole), a developing pole 5*b*(N pole) and a collecting pole 5*c*(S pole). Fixed magnet member 5 is attached to developing unit 1 with its position fixed so that magnetic poles 5*a* to 5*c* will not move if developing sleeve 2 rotates. Magnetic poles 5*a* to 5*c* form a magnetic field outside developing sleeve 2. The magnetic force acting on the developer, in the magnetic field formed by magnetic poles 5*a* to 5*c* and the electrostatic force generated by triboelectrification of the developer with the peripheral surface of rotating developing sleeve 2 cause developer 10 to adhere to the peripheral surface of developing sleeve 2. The amount of developer 10 adhering on the peripheral surface of developing sleeve 2 is regulated by a doctor 4 which is attached on the lower side of opening 1*a* of developing unit 10.

As developing sleeve 2 rotates with developer 10 adhering to the peripheral surface thereof, developer 10 is formed into spikes and comes into contact with the peripheral surface of photosensitive drum 20 around the developing position P where the distance between the peripheral surface of developing sleeve 2 and that of photosensitive drum 20 is minimum. At that time, only the toner of developer 10 is electrostatically attracted to the static latent image formed on the peripheral surface of photosensitive drum 20 to thereby develop the static latent image into a toner image. The developer 10 supported on the peripheral surface of developing sleeve 2 having passed through developing position P is collected into developing unit 1 as developing sleeve 2 rotates.

A magnetic member 6 is fixed on the upper face of developing unit 1, at a position opposing collecting magnetic pole 5*c*, of multiple magnetic poles 5*a* to 5*c* of fixed magnet 5, which is located on the downstream side with respect to the rotational direction of the peripheral surface of developing sleeve 2 (the conveyed direction of developer 10). Magnetic member 6 is kept away from the peripheral surface of developing sleeve 2 and located outside the conveyance path of developer 10 created by the rotation of developing sleeve 2 and agitating roller 3, and is arranged at such a position that its magnetic force will have no influence on the magnetic field of developing magnetic pole 5*b*.

As shown in FIG. 2, magnetic member 6 is configured of a plurality of magnetic poles 6a arranged in two rows in parallel with the axial direction of developing sleeve 2. Further, layout range L2 of magnetic poles 6*a* on magnetic member 6 in the axial direction of developing sleeve 2 is set equal to or shorter than the length L1 of collecting magnetic pole 5*c*. Magnetic member 6 forms a magnetic field between itself and collecting magnetic pole 5*c* in conformity with the polarity of magnetic member 6.

Illustratively, when magnetic member 6 is arranged with its N pole facing developing sleeve 2, and hence presents a polarity opposite to collecting magnetic pole 5*c*, the attraction of developer 10 to the peripheral surface of developing sleeve 2 is weakened by the magnetic attraction of magnetic member 6. On the other hand, when magnetic member 6 is arranged with its S pole facing developing sleeve 2, and hence presents the same polarity as collecting magnetic pole 5*c*, the developer 10 being conveyed through the developer conveyance path is magnetized in such a direction as to repel the peripheral surface of developing sleeve 2. In either case, the adhering state of developer 10, having passed through the developing position P, to the peripheral surface of developing sleeve 2 is unstable, so that the developer 10 having adhered to the peripheral surface of developing sleeve 2 will easily drop off from the peripheral surface of developing sleeve 2 after passage of the developing position P.

All the developing units 1 according to the second to fourth examples shown in FIGS. 3 through 5 are configured in a similar manner as that of the first example with partial geometrical modifications on the condition that a magnetic member 6 formed of permanent magnets is arranged at a position opposing the downstream side of the developing position P in the developer conveyance path formed by developing sleeve 2 whilst being kept away from the developer 10 residing outside the downstream area, away from the developing position P, in the developer conveyance path formed by developing sleeve 2 and being kept out of contact with the peripheral surface of developing sleeve 2.

In the developing unit 1 of the second example shown in FIG. 3, a magnetic member 6 is arranged at a position so as not to come in contact with the developer 10 residing on the downstream side of the developing position P in the developer conveyance path formed by developing sleeve 2. In the developing unit 1 of the third example shown in FIG. 4, two pieces as magnetic member 6 are arranged at two sites opposing the downstream side of the developing position P in the developer conveyance path formed by developing sleeve 2. In the developing unit 1 of the fourth example shown in FIG. 5, a magnetic member 6 is arranged in a partitioning wall projected downward from the top face of developing unit 1. In this way, in developing unit 1 of the first mode of the invention, magnetic member 6 can be arranged in various manners within the range wherein the above conditions are satisfied.

By the above configurations of developing units 1 according to the first to fourth examples, it is possible to reduce the developer's attraction to the peripheral surface of developing sleeve 2 and positively remove developer 10 from the peripheral surface of developing sleeve 2, by the action of the magnetism from magnetic member 6 onto the developer 10 having passed through the developing position P and adhering to the peripheral surface of developing sleeve 2.

Since magnetic member 6 is kept away from the developer conveyed by developing sleeve 2 and agitating roller 3 and from the peripheral surface of developing sleeve 2, little mechanical stress acts on developer 10. As a result, toner aggregation or toner filming over the peripheral surface of developing sleeve 2 as well as separation or embedment of external additives with respect to the toner surface will not occur, hence no degradation of image quality and/or toner scattering will occur.

Further, since layout range L2 of magnetic poles 6*a* on magnetic member 6 in the axial direction of developing sleeve 2 is set equal to or shorter than the length L1 of collecting magnetic pole 5*c*, developer 10 conveyed by developing sleeve 2 will not spread out beyond both ends of the developer conveyance path formed by magnetic poles 5*a* to 5*c*. Therefore, no developer will enter the bearings etc. of developing sleeve 2 and hence no toner aggregation, toner scattering as well as no rotation failure of developing sleeve 2 will occur.

Additionally, since magnetic member 6 is arranged at a position so that its magnetic force will not affect the magnetic field created by developing magnetic pole 5*b*, toner transfer from the developing sleeve 2 side to the static latent image on the surface of the photosensitive drum 20 at the developing position P will not be disturbed and hence no lowering of the image density or no degradation of image quality such as background fogging etc. will occur.

Also, magnetic member 6 may be moved in the axial direction of developing sleeve 2 in a reciprocating manner so as to vibrate developer 10 that is adhering to the peripheral surface of developing sleeve 2, thus making it possible to easily separate the developer from the peripheral surface of developing sleeve 2. Further, in magnetic member 6, it is possible to arrange plural magnetic poles 6*a* laid out along the axial direction of developing sleeve 2, with the polarities of the magnetic poles facing the developer conveyance path being alternated.

Figure 6:
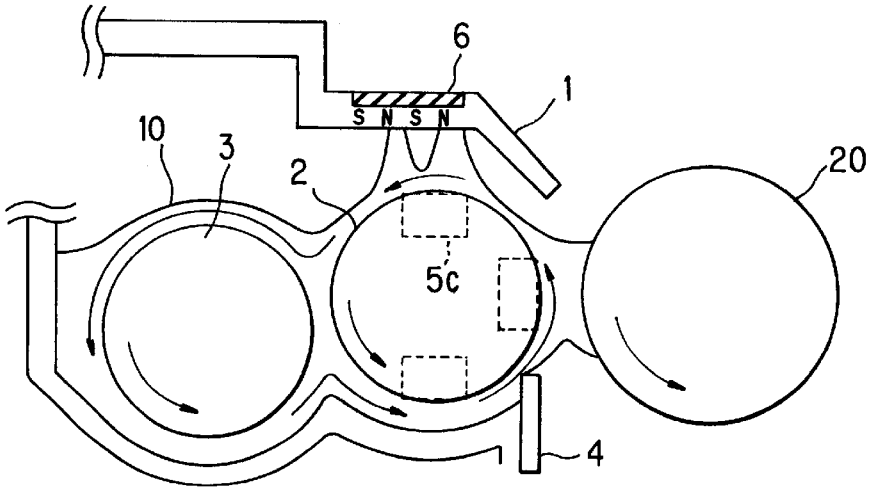
FIG. 6 is a sectional view showing the configuration of the fifth example of the developing unit.
Figure 7:
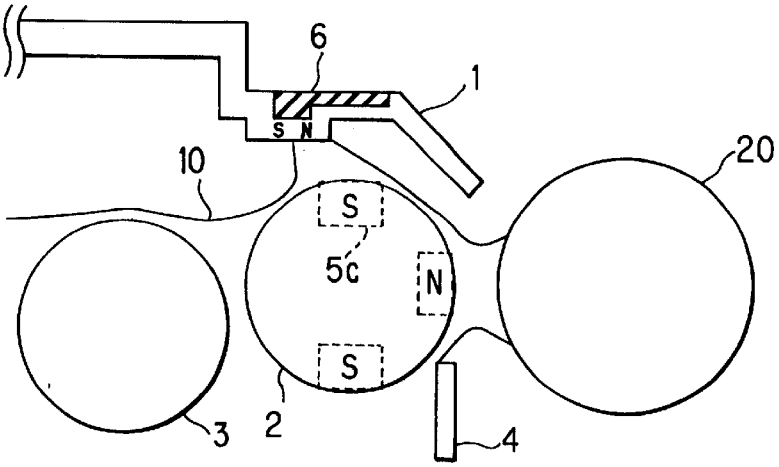
FIG. 7 is a sectional view showing the configuration of the sixth example of the developing unit.
Figure 8:
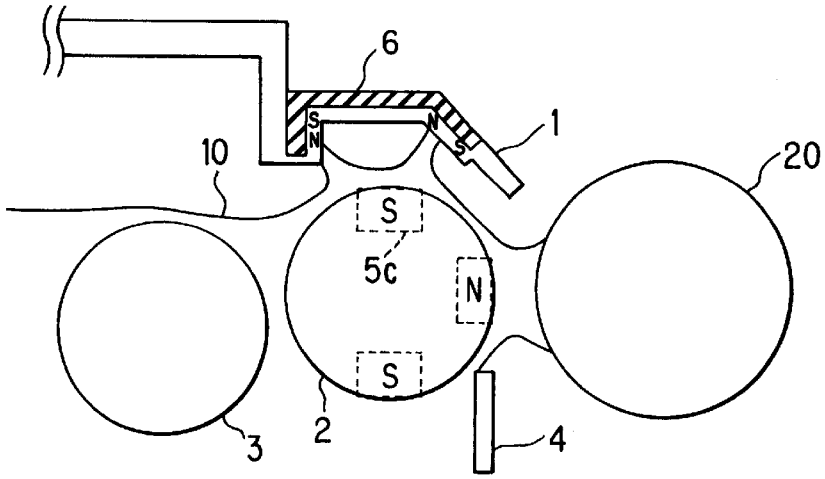
FIG. 8 is a sectional view showing the configuration of the seventh example of the developing unit.
Figure 9:
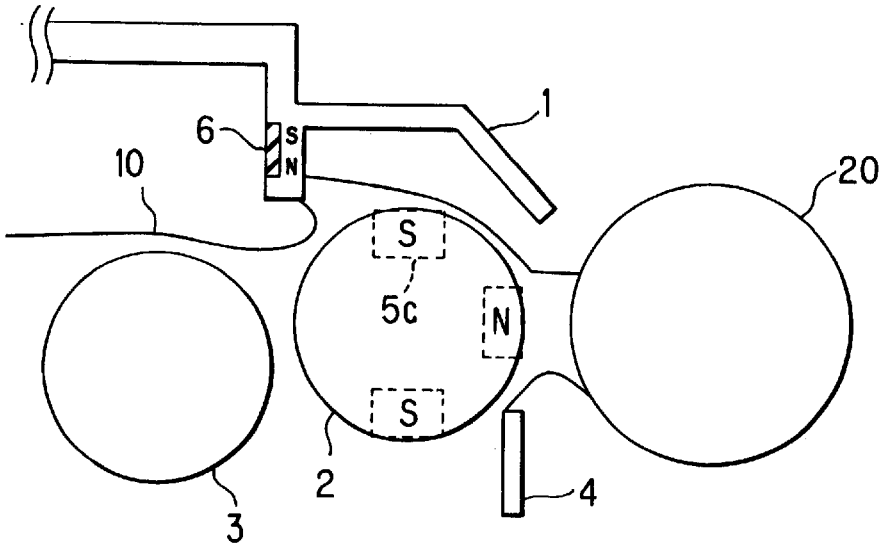
FIG. 9 is a sectional view showing the configuration of the eighth example of the developing unit.

FIG. 6 is a sectional view showing a configuration of the fifth example of a developing unit in accordance with the embodiment of the invention. FIGS. 7 through 9 are sectional views showing the configurations of the sixth through eighth examples of the developing units in accordance with the embodiment of the invention. In developing unit 1 of the embodiment, a magnetic member 6 is configured of at least a pair (two pairs in this example) of magnetic poles of different polarities arranged in the rotational direction of developing sleeve 2 or in the conveyed direction of developer 10. Other configurations are the same as the developing unit 1 in the first example shown in FIG. 1.

In this configuration, the developer 10 that is adhering to the peripheral surface of developing sleeve 2, after passing through the developing position P, alternately opposes N and S poles of magnetic member 6 twice for each. When the developer 10 that is adhering to the peripheral surface of developing sleeve 2 opposes the N pole of magnetic member 6, the developer is magnetized in such a direction as to be attracted to magnetic member 6 and hence the attraction to the peripheral surface of developing sleeve 2 is weakened. When the developer 10 that is adhering to the peripheral surface of developing sleeve 2 opposes the S pole of magnetic member 6, the developer is magnetized in such a direction as to repulse the peripheral surface of developing sleeve 2.

Therefore, developer 10 adhering to the peripheral surface of developing sleeve 2, after passing through the developing position P, is repeatedly magnetized in varying directions by magnetic member 6 so that the adhering state of the developer 10, having passed through the developing position P, to the peripheral surface of developing sleeve 2 is made further unstable. As a result, the developer 10 having adhered to the peripheral surface of developing sleeve 2 will further easily drop off from the peripheral surface of developing sleeve 2 after its passage of the developing position P.

All the developing units 1 according to the sixth to eighth examples shown in FIGS. 7 through 9 are configured in a similar manner as that of the fourth example with partial geometrical modifications on the condition that a magnetic member 6 having at least a pair of magnetic poles of different polarities arranged in the rotational direction of developing sleeve 2 is arranged at a position opposing the downstream side of the developing position P in the developer conveyance path formed by developing sleeve 2 whilst being kept away from the developer 10 residing outside the downstream area, away from the developing position P, in the developer conveyance path formed by developing sleeve 2 and being kept out of contact with the peripheral surface of developing sleeve 2. Other configurations are the same as the developing unit in the fourth example.

In the developing unit 1 of the sixth example shown in FIG. 7, a magnetic member 6 is arranged at a position so as not to come in contact with the developer 10 residing on the downstream side of the developing position P in the developer conveyance path formed by developing sleeve 2. In the developing unit 1 of the seventh example shown in FIG. 8, two pieces as magnetic member 6 are arranged at two sites on the downstream side of the developing position P in the developer conveyance path formed by developing sleeve 2. In the developing unit 1 of the eighth example shown in FIG. 9, a magnetic member 6 is arranged in a partitioning wall projected downward from the top face of developing unit 1. In this way, in developing unit 1 of the invention, magnetic member 6 can be arranged in various manners within the range wherein the above conditions are satisfied.

By the above configurations, developing units 1 according to the fifth to eighth examples, it is possible to reduce the developer's attraction to the peripheral surface of developing sleeve 2 and further positively remove developer 10 from the peripheral surface of developing sleeve 2, by the action of magnetism from magnetic member 6 onto the developer 10, having passed through the developing position P and adhering to the peripheral surface of developing sleeve 2, i.e., such an action as to repeatedly magnetize the developer 10 with alternating polarities.

Figure 10:
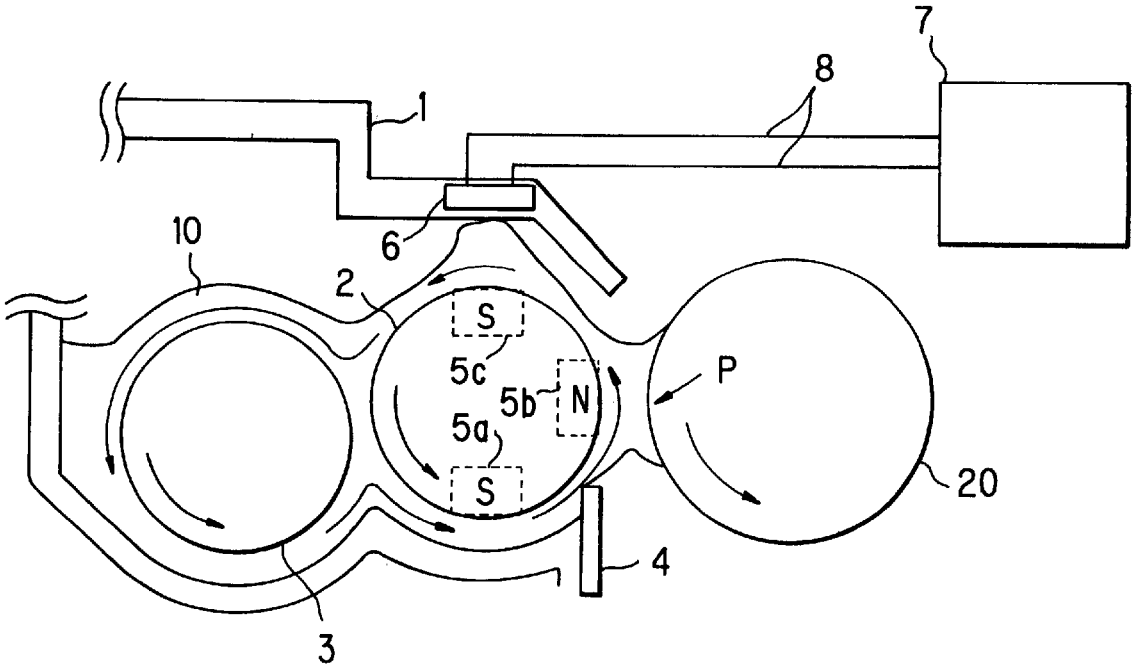
FIG. 10 is a sectional view showing the configuration of the ninth example of the developing unit.
Figure 11:
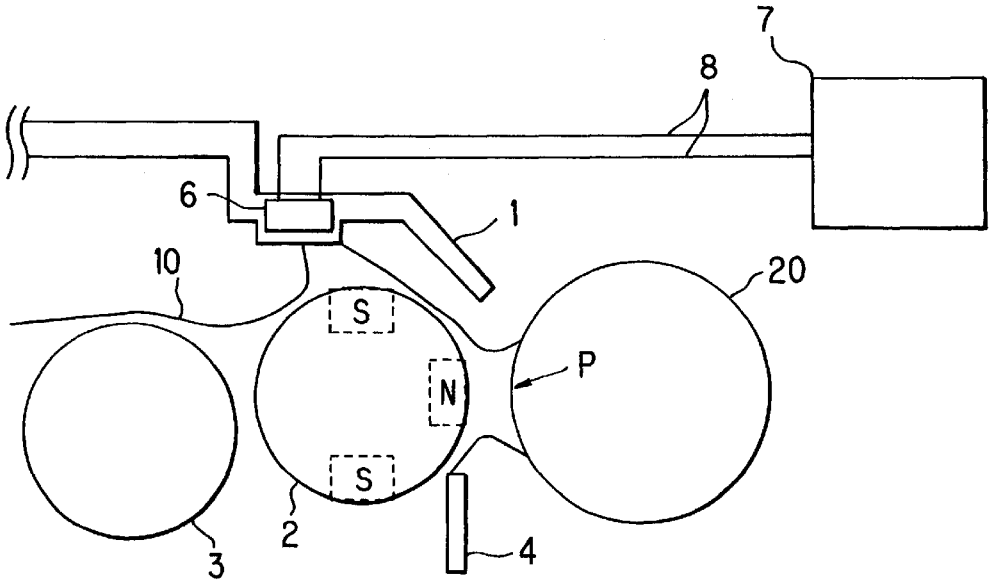
FIG. 11 is a sectional view showing the configuration of the tenth example of the developing unit.
Figure 12:
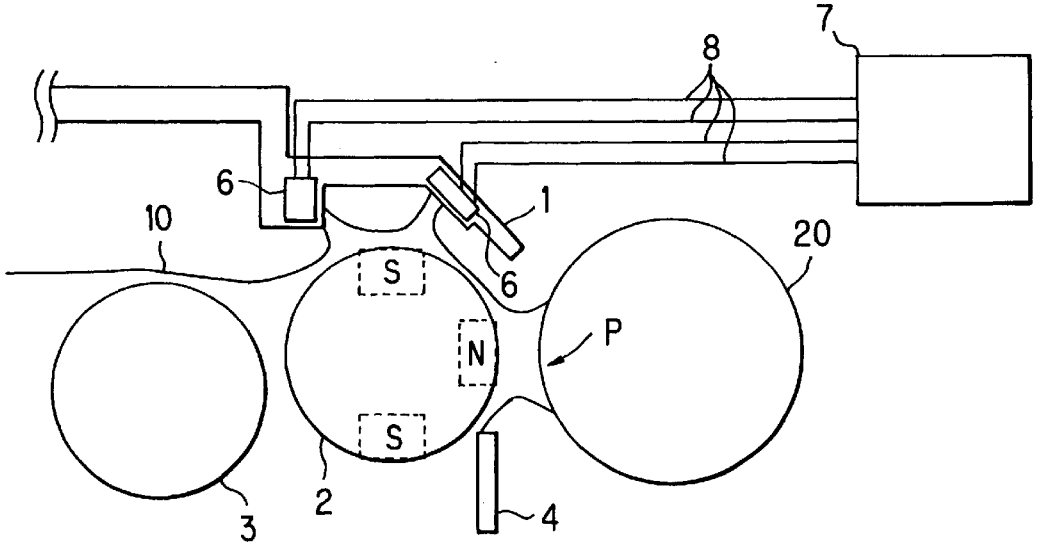
FIG. 12 is a sectional view showing the configuration of the eleventh example of the developing unit.
Figure 13:
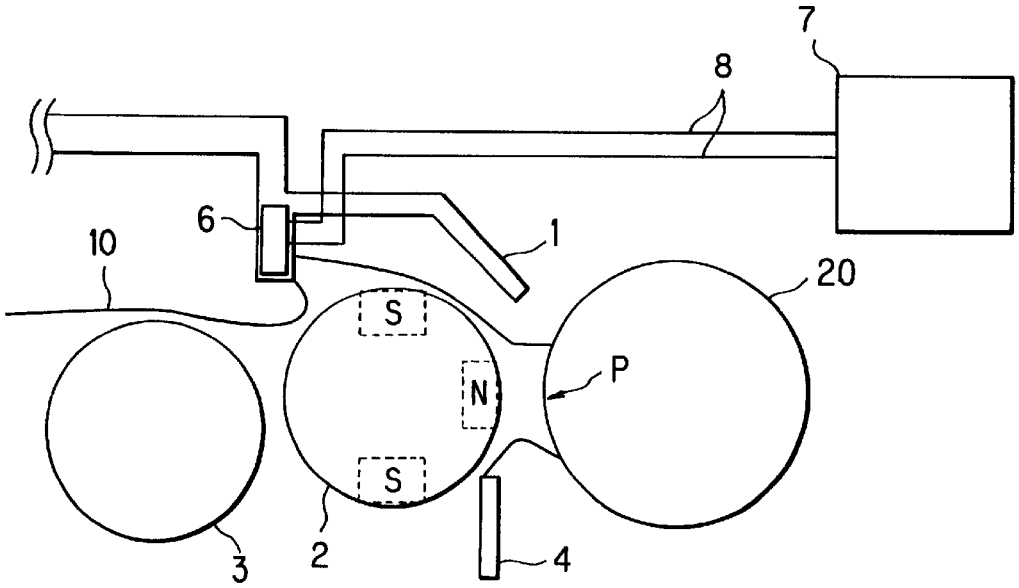
FIG. 13 is a sectional view showing the configuration of the twelfth example of the developing unit.

FIG. 10 is a sectional view showing a configuration of the ninth example of a developing unit in accordance with the embodiment of the invention. FIGS. 11 through 13 are sectional views showing the configurations of the tenth through twelfth examples of the developing units in accordance with the embodiment of the invention. In developing unit 1 of this embodiment, a magnetic member 6 is configured of an electromagnet that has been supplied the current from a current control circuit 7 via a power source line 8. Other configurations are the same as the developing unit 1 in the first example shown in FIG. 1.

The electromagnet constituting magnetic member 6 is composed of a coil wound on the peripheral side of a core of which one end face is opposed to the developer conveyance path formed by developing sleeve 2. As current is supplied from current control circuit 7 via power source line 8 to the electromagnet, i.e., magnetic member 6, the end face of the core opposing the developer conveyance path is magnetized to become magnetic pole, with polarity dependent on the direction of current from current control circuit 7 and the direction of coil winding in magnetic member 6.

By this configuration, the developer 10 adhering to the peripheral surface of developing sleeve 2, after passing through the developing position P, opposes the end face of the electromagnet which is magnetized as to be a N or S pole. When the end face of the electromagnet constituting magnetic member 6 is magnetized as to be a N pole, the developer 10 having passed through the developing position P and adhering to the peripheral surface of developing sleeve 2 is magnetized in such a direction so as to be attracted to magnetic member 6 and hence the attraction to the peripheral surface of developing sleeve 2 is weakened. When the end face of the electromagnet constituting magnetic member 6 is magnetized as to be an S pole, the developer 10 having passed through the developing position P and adhering to the peripheral surface of the developing sleeve 2 is magnetized in such a direction as to repulse the peripheral surface of developing sleeve 2.

Therefore, the attraction of the developer 10 adhering to the peripheral surface of developing sleeve 2 having passed through the developing position P, to the peripheral surface of developing sleeve 2 is weakened by magnetic member 6 so that the adhering state to the peripheral surface of developing sleeve 2 is unstable. As a result, the developer 10 having adhered to the peripheral surface of developing sleeve 2 will easily drop off from the peripheral surface of developing sleeve 2 after passage of the developing position P.

All the developing units 1 according to the tenth to twelfth examples shown in FIGS. 11 through 13 are configured in a similar manner as that of the ninth example with partial geometrical modifications on the condition that a magnetic member 6 having electromagnets of N or S pole on one end face thereof opposing the developer conveyance path formed by developing sleeve 2 is arranged at a position opposing the downstream side of the developing position P in the developer conveyance path formed by developing sleeve 2 whilst being kept away from the developer 10 residing outside the downstream area, away from developing position P, in the developer conveyance path formed by developing sleeve 2 and being kept out of contact with the peripheral surface of developing sleeve 2. Other configurations are the same as the developing unit in the ninth example.

In the developing unit 1 of the tenth example shown in FIG. 11, a magnetic member 6 is arranged at a position so as not to come in contact with the developer 10 residing on the downstream side of the developing position P in the developer conveyance path formed by developing sleeve 2. In the developing unit 1 of the eleventh example shown in FIG. 12, two pieces as magnetic member 6 are arranged at two sites opposing the downstream side of the developing position P in the developer conveyance path formed by developing sleeve 2. In the developing unit 1 of the twelfth example shown in FIG. 13, a magnetic member 6 is arranged in a partitioning wall projected downward from the top face of developing unit 1. In this way, in developing units 1 of the embodiments of the invention, magnetic member 6 made up of electromagnets can be arranged in various manners within the range wherein the above conditions are satisfied.

By the above configurations, developing units 1 according to the ninth to twelfth examples, it is possible to reduce the developer's attraction to the peripheral surface of developing sleeve 2 and more positively remove developer 10 from the peripheral surface of developing sleeve 2, by the action of magnetism from magnetic member 6 on the developer 10 having passed through the developing position P and adhering to the peripheral surface of developing sleeve 2.

Further, when the direction of the current from current control circuit 7 to the coil of electromagnet constituting magnetic member 6 is switched, the polarity at the end face of magnetic member opposing the developer conveyance path may be changed so that the polarity, affected by the magnetism of magnetic member 6, of the developer 10 having passed through the developing position P and adhering to the peripheral surface of developing sleeve 2 will change. Accordingly, if magnetic member 6 is configured of only a single electromagnet with respect to the rotational direction of the peripheral surface of developing sleeve 2, it is possible to repeatedly vary the magnetized direction of the developer 10 having passed through developing position P, similarly to the above fifth to eighth example, and make the adhering state of the developer 10, having passes through developing position P on the peripheral surface of developing sleeve 2 further unstable by periodically switching the direction of the current from current control circuit 7. Thus, it is possible to further easily remove developer 10 having passed through the developing position P from the peripheral surface of developing sleeve 2.

Further, a plurality of cores each having coil wound thereon and an end face opposing the developer conveyance path may be arranged as a magnetic member 6 within a predetermined range located downstream of the developing position P in the developer conveyance path formed by developing sleeve 2. By this configuration, it is possible to finely control the magnetism of magnetic member 6 acting on the developer 10 that is adhering to peripheral surface of developing sleeve 2 having passed through developing position P.

Figure 14A:
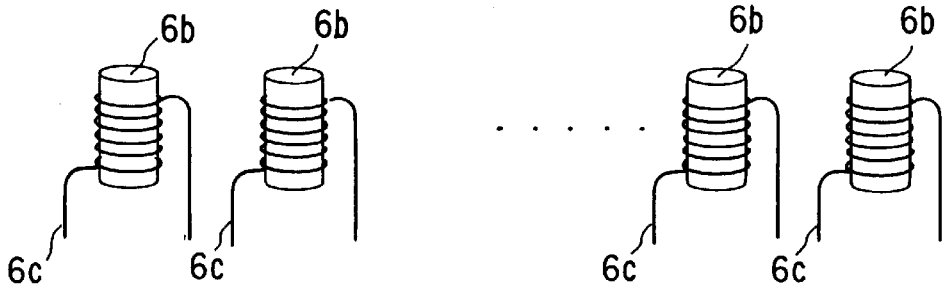
FIGS. 14A and 14B are views showing wound states of electromagnetic coils constituting individual magnetic members in the developing units of the above ninth embodiment.

Illustratively, as shown in FIG. 14A, in magnetic member 6 having a plurality of cores 6*b* arrayed in the rotational or axial direction along the peripheral surface of developing sleeve 2, when each core 6*b* has a coil 6c wound in the same direction as others, each coil may be controlled individually as to its current passing through from current control circuit 7 so that the magnetized direction of the developer 10 adhering to the peripheral surface of developing sleeve 2 after passage of developing position P may be controlled locally by individual magnetic force of a plurality of cores 6*b*.

For example, in a case where a plurality of cores 6*b* of magnetic member 6 are laid out along the peripheral surface of developing sleeve 2 in the rotational direction thereof, if reversed currents are supplied to coils 6*c* wound around cores 6*b* adjacent to each other, it is possible to change or reverse, at least twice, the direction of magnetism of developer 10 that is adhering to the peripheral surface of rotating developing sleeve 2 and passing through the developer conveyance path on the downstream side of the developing position P, whereby the attraction of developer 10 to the peripheral surface of developing sleeve 2 can be effectively attenuated to thereby efficiently remove developer 10 from the peripheral surface of developing sleeve 2 after passage of the developing position P. In this case, when periodically reversing current is supplied to each coil 6*c*, the number of reverses in the direction of magnetism of developer 10 may be increased so as to further provide an enhanced attenuation of the attraction of developer 10 to the peripheral surface of developing sleeve 2 after passage of the developing position P.

In a case where a plurality of cores 6*b* of magnetic member 6 are laid out in the axial direction of developing sleeve 2, by controlling the direction of the current flowing through each coil 6*c* wound around the core 6*b* adjacent to each other, it is possible to selectively magnetize the developer 10 located within a range opposing each core 6*b* along the axial direction of developing sleeve 2, in accordance with the history of the state of development in each range, for example.

Figure 14B:
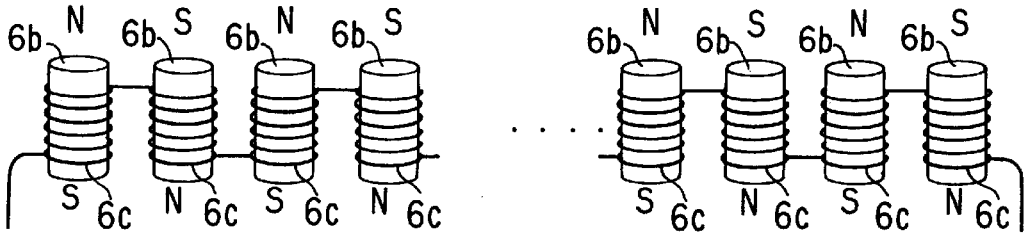

In the above way, in a magnetic member 6 which is configured of a plurality of cores 6*b* arranged in a certain direction, if the layout of cores 6*b* forming opposite magnetic fields to one another is determined, it is possible to simplify the configuration and current control of current control circuit 7 by forming different windings of coils 6*c* for cores 6*b* forming magnetic fields of opposing polarities. For example, as shown in FIG. 14B, if adjoining cores 6*b* in magnetic member 6 are made to create magnetic fields of opposite polarities, the windings of coils 6*c* around a plurality of cores 6*b* may be formed alternately reversed. Thus, it is possible to simplify the configuration and current control of current control circuit 7 without the necessity of individually controlling coils 6*c* as to their current direction.

Figure 15A:
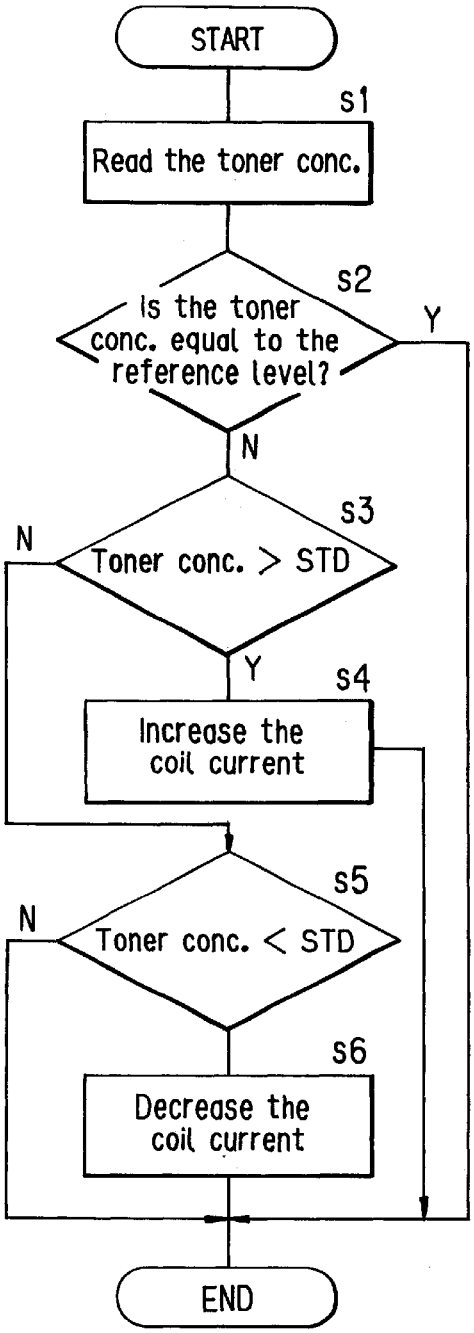
FIGS. 15A and 15B are flowchart showing examples of procedural steps of a current control circuit in the developing unit of the ninth example.
Figure 15B:
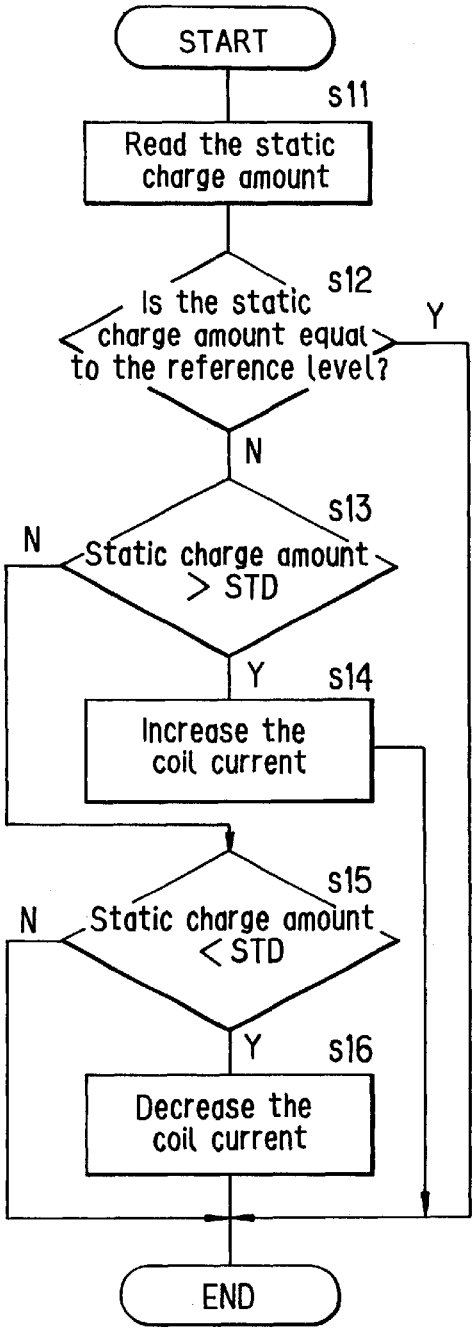

FIGS. 15A and 15B are flowcharts showing examples of procedural steps of the current control circuit in the developing units of the ninth to twelfth examples. As stated above, developing unit 1 of ninth to twelfth examples, magnetic member 6 is configured of an electromagnet, to which electric current is supplied from current control circuit 7. In this configuration, the direction of current supplied from current control circuit 7 to the electromagnet constituting magnetic element 6 may be altered as stated above so as to change the direction of magnetism of the developer 10 adhering to the peripheral surface of developing sleeve 2 after passage of the developing position P, thus making it possible to weaken the attraction of developer 10 to the peripheral surface of developing sleeve 2. With this operation, if the current to be supplied from current control circuit 7 to the electromagnet constituting magnetic member 6 is varied, the intensity of magnetism of developer 10 adhering to the peripheral surface of developing sleeve 2 after passage of the developing position P varies and hence the attenuation of the attraction of developer 10 to the peripheral surface of developing sleeve 2 also varies.

The state of separating developer 10 from the peripheral surface of developing sleeve 2 after passage of developing position P is affected by the developer's conditions which vary depending upon its use state and also has an influence upon the developing conditions of the static latent image which change depending upon the adhering amount of the developer on the peripheral surface of developing sleeve 2. Therefore, the state of separating developer 10 from the peripheral surface of developing sleeve 2 may be varied in accordance with the developer's conditions such as toner concentration, density, resistivity, charge amount, fluidity and the like so as to regulate the adherence of the developer on the peripheral surface of developing sleeve 2, thus making it possible to maintain a correct state of development and prevent the degradation of image quality.

In the example shown in FIG. 15A, developer 10 is of a dual-component developer consisting of a toner and a carrier. Once toner is supplied to developing unit 1, the toner concentration rises. As the developing process is repeated, the toner concentration lowers. In such a case, the toner concentration in developer 10 stored in developing unit 1 is detected and the current to magnetic member 6 is increased or decreased depending upon the detection result of the toner concentration, so as to adjust the amount of separation of the carrier that is adhering to the peripheral surface of developing sleeve 2, and thereby keep the toner concentration in the developer 10 held in developing unit 1 constant.

For this purpose, current control circuit 7 reads the toner concentration detected by an unillustrated toner concentration sensor provided for developing unit 1 (s1) and compares the detected toner concentration to the reference level (s2). In this comparison, current control circuit 7 increases the current to be supplied to coil 6*c* constituting magnetic member 6 if the detected value of the toner concentration is higher than the reference level STD (s3 and s4). If the detected value of the toner concentration is lower than the reference level STD, the circuit decreases the current to be supplied to coil 6*c* constituting magnetic member 6 (s5 and s6).

Figure 16A:
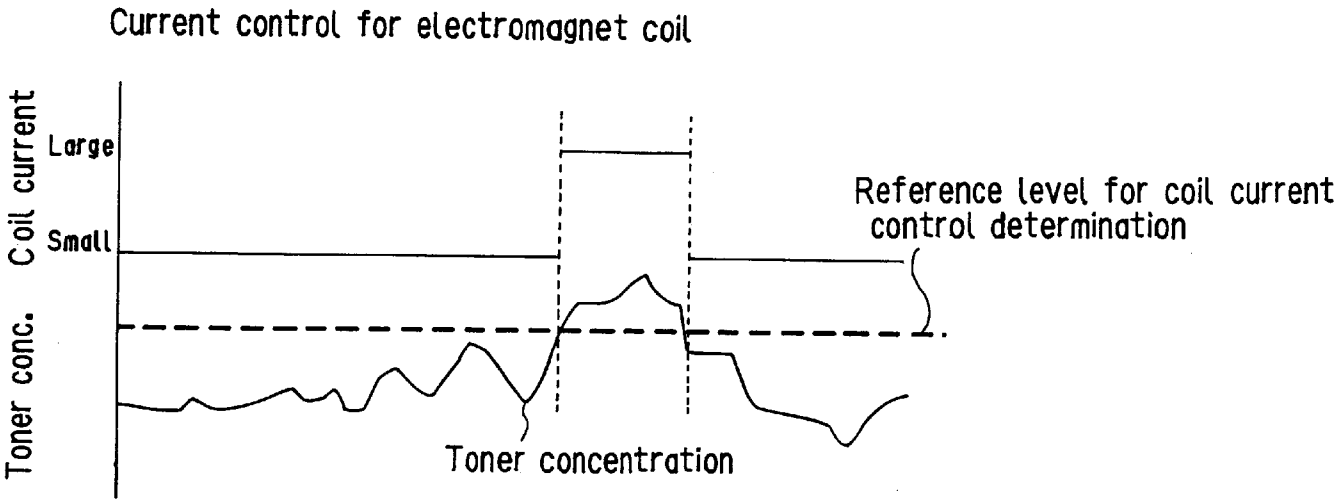
FIGS. 16A and 16B show charts representing the controlled states of the current level supplied to the magnetic member from the current control circuit in the developing unit of the ninth example.

By this operation, as shown in FIG. 16A, if the toner concentration in the developer 10 in developing unit 1 is higher than the reference level, the magnetic force of magnetic member 6 acting on the carrier that is adhering to the peripheral surface of developing sleeve 2 is enhanced so as to increase the amount of the carrier separated from developing sleeve 2 and hence lower the toner concentration. In contrast, if the toner concentration in the developer 10 in developing unit 1 is lower than the reference level, the magnetic force of magnetic member 6 acting on the carrier that is adhering to the peripheral surface of developing sleeve 2 is weakened so as to decrease the amount of the carrier separated from developing sleeve 2 and hence increase the toner concentration.

In the example shown in FIG. 15B, taking into account the fact that the amount of static charge on the developer will increase or decrease depending upon the stored amount of developer 10 in developing unit 1, the amount of static charge on developer 10 stored in developing unit is detected. The current to magnetic member 6 is increased or decreased in accordance with the detected result of the static charge amount so that the amount of separation of the developer from the peripheral surface of developing sleeve 2 is varied to thereby maintain a constant amount of static charge on developer 10 in developing unit 1.

For this purpose, current control circuit 7 reads the amount of static charge on developer 10 detected by an unillustrated static charge amount sensor (s11) in developing unit 1 and compares the detected static charge amount to the reference level (s12). In this comparison, current control circuit 7 increases the current to be supplied to coil 6*c* constituting magnetic member 6 if the detected value of the static charge amount is higher than the reference level STD (s13 and s14). If the detected value of the static charge amount is lower than the reference level STD, the circuit decreases the current to be supplied to coil 6*c* constituting magnetic member 6 (s15 and s16).

Figure 16B:
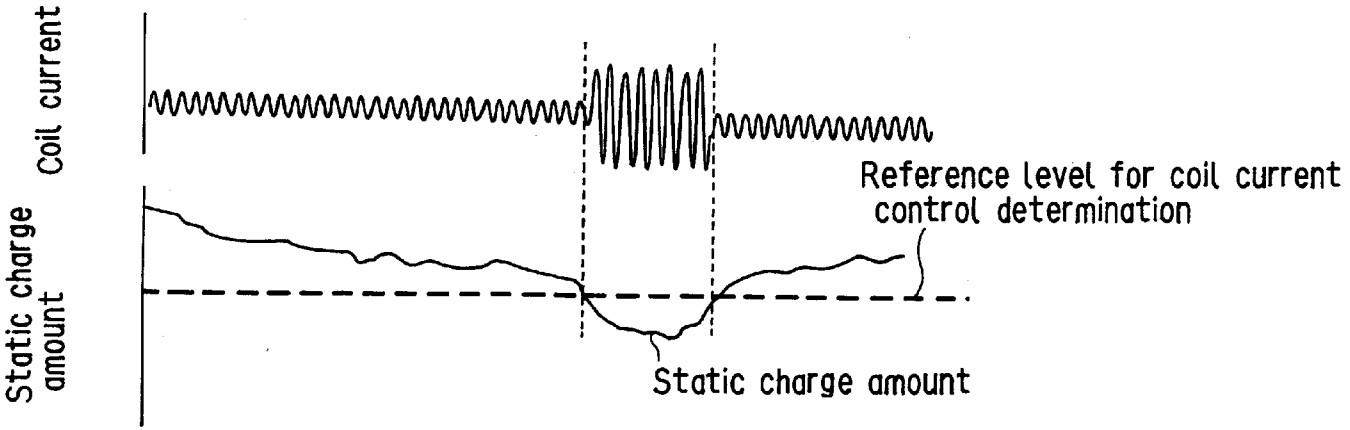

By this operation, as shown in FIG. 16B, if the amount of static charge on the developer 10 in developing unit 1 is higher than the reference level, the magnetic force of magnetic member 6 acting on the developer that is adhering to the peripheral surface of developing sleeve 2 is enhanced so as to increase the amount of the developer separated from developing sleeve 2 and hence increase the stored amount of developer 10 in developing unit 1, whereby the amount of static charge on developer 10 per unit volume is lowered. In contrast, if the amount of static charge on developer 10 in developing unit 1 is lower than the reference level, the magnetic force of magnetic member 6 acting on developer 10 that is adhering to the peripheral surface of developing sleeve 2 is weakened so as to decrease the amount of the developer separated from developing sleeve 2 and hence decrease the stored amount of developer 10 in developing unit 1, whereby the amount of static charge on developer 10 per unit volume is heightened.

It is also possible to obtain the same effect by making longer or shorter the period that the current alternates direction as it is supplied to magnetic member 6 instead of increasing or decreasing the current to be supplied to magnetic member 6 at the above steps at s4, s6, s14 and s16.

It is also possible to perform the operation of varying the current to be supplied to magnetic member 6 or the operation of making longer or shorter the period that the current alternates direction as it is supplied to magnetic member 6, in accordance with the developer's conditions such as toner density, resistivity, fluidity and the like, which are adjustable by varying the developer's attraction to the peripheral surface of developing sleeve 2.

Figure 17:
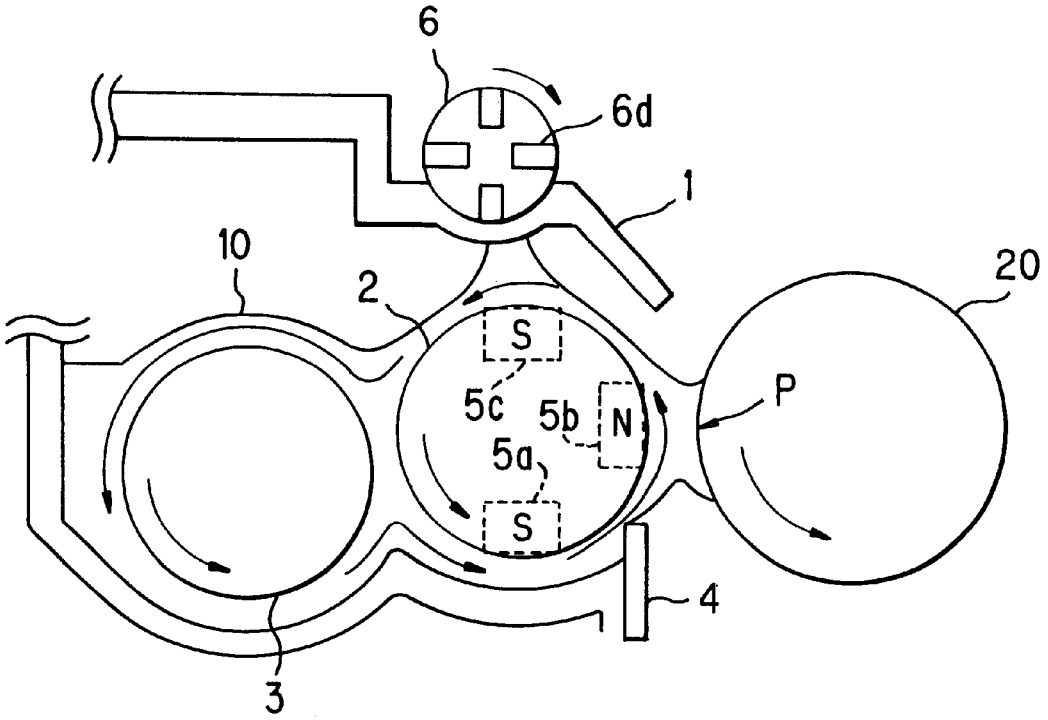
FIG. 17 is a sectional view showing the configuration of the thirteenth example of the developing unit.

FIG. 17 is a sectional view showing the configuration of the thirteenth example of a developing unit in accordance with the embodiment of the invention. FIGS. 18 through 21 are sectional views showing the configurations of the fourteenth to seventeenth examples of developing units of the embodiment of this invention. In the developing unit 1 of these examples, a magnetic member 6 is configured of a rotational body (a cylindrical form in this example) having a plurality of (four in this example) magnetic poles 6*d* arranged at regular intervals in the direction of the circumference on the peripheral surface thereof. This magnetic member 6 rotates at a fixed rate in the direction of the arrow, i.e., the direction opposite to the rotational direction of developing sleeve 2. Other configurations are the same as the developing unit 1 in the first example shown in FIG. 1.

In this configuration, magnetic poles 6*d* arranged on the peripheral surface of magnetic member 6 will oppose, in a constant cycle, the position in the developer conveyance path formed by developing sleeve 2, located downstream of the developing position P, so that the magnetism of magnetic pole 6*d* will periodically act on the developer 10 in the developer conveyance path formed by developing sleeve 2. When magnetic pole 6*d* opposing the developer 10 in the developer conveyance path is of a N pole, the developer 10 adhering to the peripheral surface of developing sleeve 2 having passed through the developing position P is magnetized in such a direction as to be attracted to magnetic member 6 and hence the developer's attraction to the peripheral surface of developing sleeve 2 is weakened. When magnetic pole 6*d* opposing the developer 10 in the developer conveyance path is of a S pole, the developer 10 adhering to the peripheral surface of developing sleeve 2 having passed through the developing position P is magnetized in such a direction as to repel the peripheral surface of developing sleeve 2.

Therefore, the attractive force acting on the developer 10 that is adhering to the peripheral surface of developing sleeve 2, after passing through the developing position P, toward the peripheral surface of developing sleeve 2 is periodically weakened by magnetic member 6 so that the adhering state of the developer 10 to the peripheral surface of developing sleeve 2 is made unstable. As a result, the developer 10 having adhered to the peripheral surface of developing sleeve 2 will easily drop off from the peripheral surface of developing sleeve 2 after its passage of the developing position P.

All the developing units 1 according to the fourteenth to seventeenth examples are, as shown in FIGS. 18 through 21, configured in a similar manner as that of the thirteenth example with partial geometrical modifications on the condition that a magnetic member 6 configured of a rotational body having a plurality of magnetic poles 6*d* of an N or S polarity, arranged at regular intervals in the direction of the circumference on the peripheral surface thereof is arranged at a position opposing the downstream side of the developing position P in the developer conveyance path formed by developing sleeve 2 whilst being kept away from the developer 10 residing outside the downstream area of developing position P in the developer conveyance path formed by developing sleeve 2 and being kept out of contact with the peripheral surface of developing sleeve 2. Other configurations are the same as the developing unit in the thirteenth example.

Figure 18:
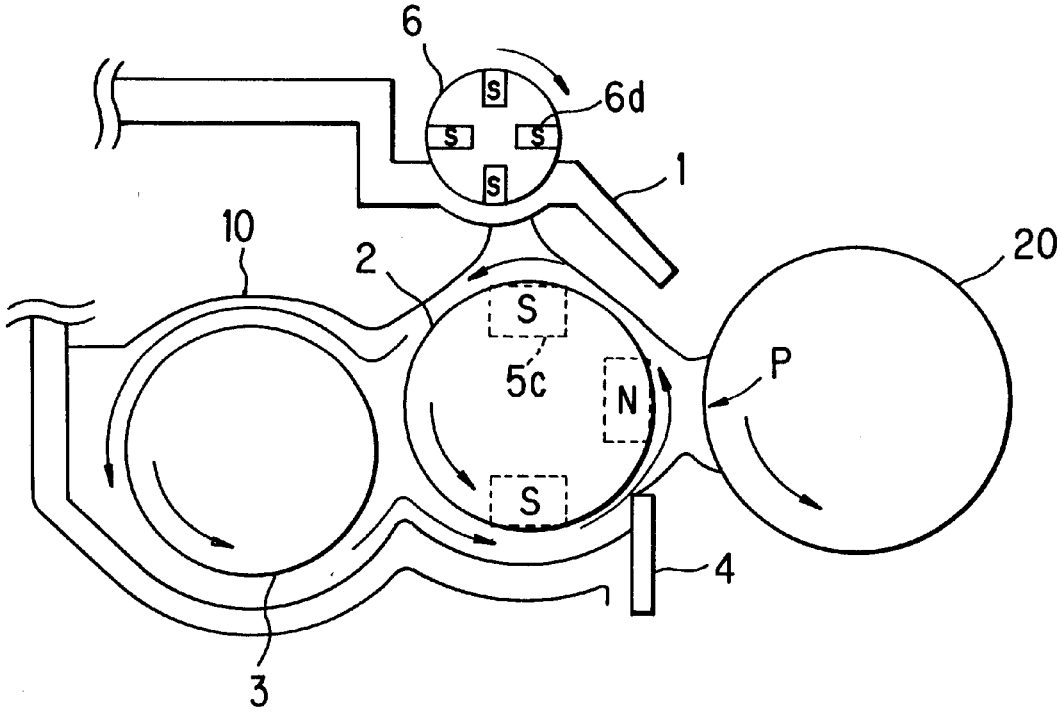
FIG. 18 is a sectional view showing the configuration of the fourteenth example of the developing unit.
Figure 19:
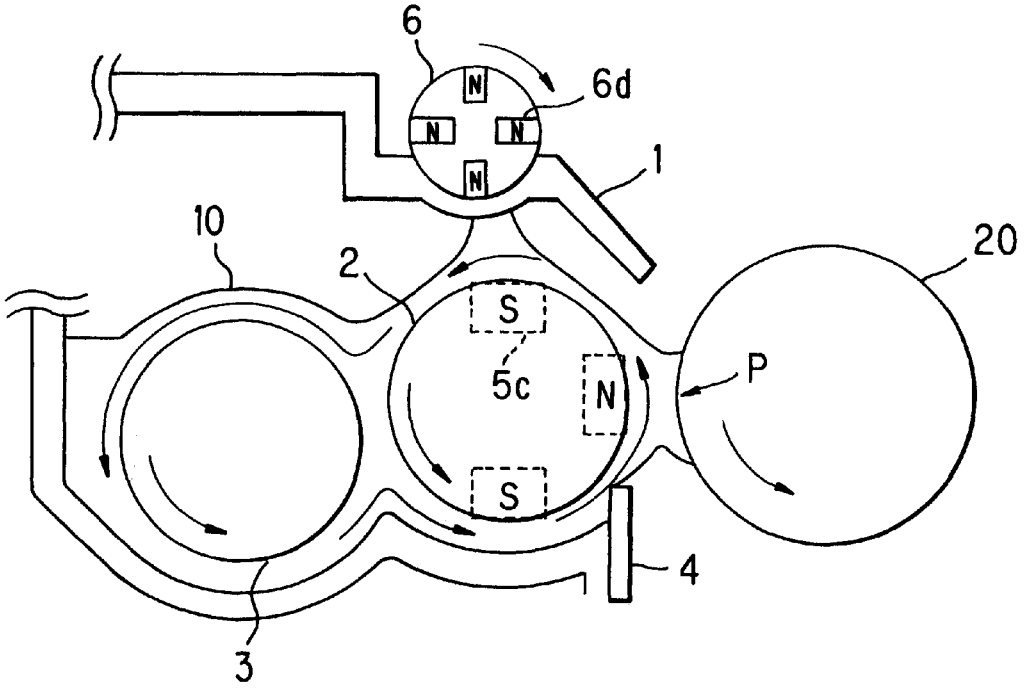
FIG. 19 is a sectional view showing the configuration of the fifteenth example of the developing unit.
Figure 20:
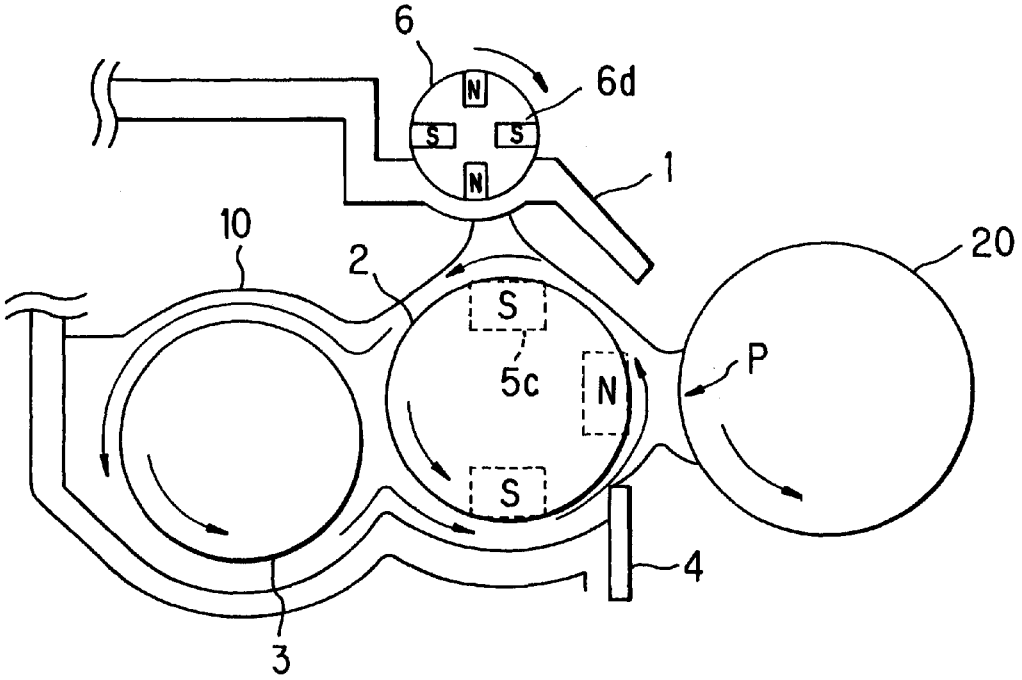
FIG. 20 is a sectional view showing the configuration of the sixteenth example of the developing unit.
Figure 21:
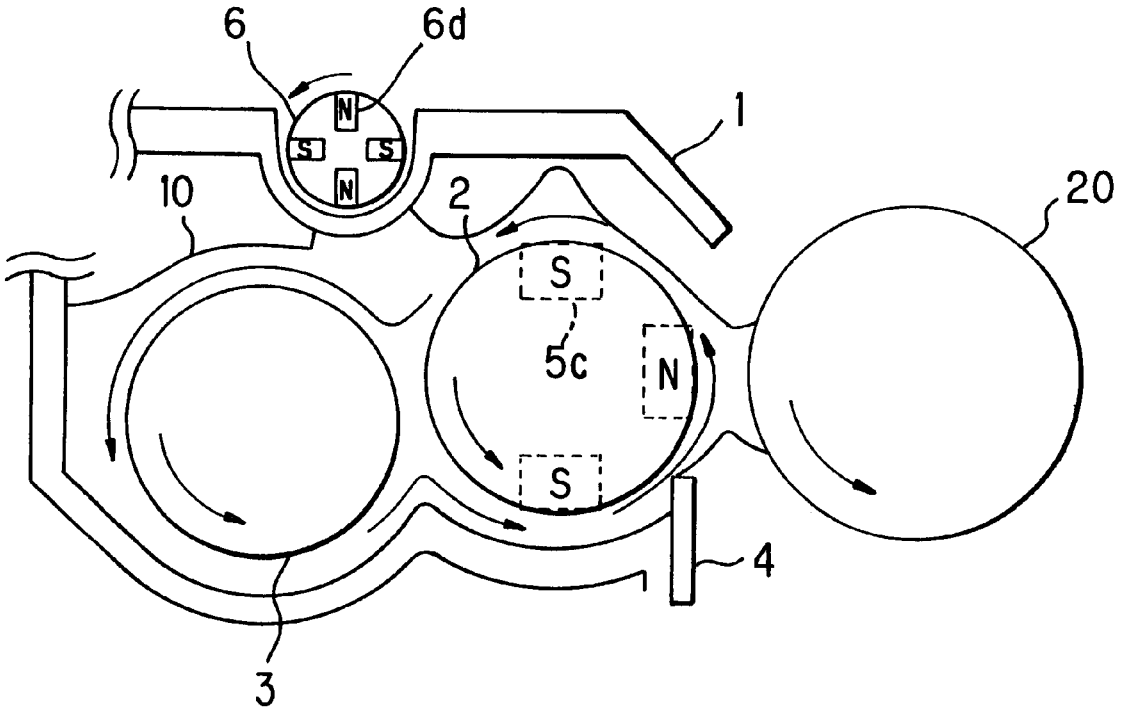
FIG. 21 is a sectional view showing the configuration of the seventeenth example of the developing unit.

In the developing unit 1 of the fourteenth example shown in FIG. 18, a magnetic member 6 has four magnetic poles 6*d* of a S polarity on the peripheral surface thereof. In the developing unit 1 of the fifteenth example shown in FIG. 19, a magnetic member 6 has four magnetic poles 6*d* of a N polarity on the peripheral surface thereof. In the developing unit 1 of the sixteenth example shown in FIG. 20, a magnetic member 6 has four magnetic poles 6*d* of N and S polarities arranged alternately on the peripheral surface thereof. In the developing unit 1 of the seventeenth example shown in FIG. 21, a magnetic member 6 is arranged at a position opposing the developer conveyance path between developing sleeve 2 and agitating roller 3.

By the above configurations, developing units 1 according to the thirteenth to seventeenth examples, it is possible to reduce the developer's attraction to the peripheral surface of developing sleeve 2 and further positively remove developer 10 from the peripheral surface of developing sleeve 2, by the periodic action of magnetism from magnetic member 6 onto the developer 10 having passed through the developing position P and adhering to the peripheral surface of developing sleeve 2 so as to periodically magnetize developer 10.

FIG. 22 is a table showing the results of image formation using the above first to seventeenth developing units of this invention, compared with those obtained from developing units of comparative examples. More specifically, FIG. 22 shows the evaluation of image density, fogging density, developer's circulation performance, toner aggregation, toner filming over the developing sleeve surface, the toner filming over the carrier surface and adherence of external additives on the toner surface, which was made by image formation of a dual-component developer using developing units 1 of the above first through seventeenth examples, in comparison with the results obtained using developing units of comparative examples 1 to 3 to be referred to hereinbelow.

For image density, the density of a formed image was measured by a PROCESS MEASUREMENTS RD914, a product of Macbeth Corporation and image density was determined as 'good' when the measurement was equal to or above 1.35. For fogging density, the background density of the paper on which an image was formed was measured by a Color Meter ZE2000, a product of NIPPON DENSHOKU INDUSTRIES CO., LTD and the fogging density was determined as 'good' when the measurement was equal to or below 0.5. For the developer's circulation performance, based on the fact that if the circulation performance of developer 10 in developing unit 1 degrades, the toner concentration in the developer on developing sleeve 2 lowers, the toner density Da in developer 10 on developing sleeve 2 and the toner density Db in developer 10 near agitating roller 3 were evaluated by observing both the samples by electron microscopy and calculating their difference, and the circulation performance was determined as 'good' when the difference between Db and Da fell within 0.5 while it was determined 'poor' when the difference was 1.0 or above.

Toner filming on the developing sleeve surface was evaluated by visual observation of the surface of developing sleeve 2. Toner filming on the carrier surface was evaluated by measuring the carbon content of the developer which was obtained by removing the toner, using a Carbon Analyzer EMIA-110, a product of HORIBA, Ltd. The toner filming was determined as 'good' when the carbon content was 0% while it was determined as 'poor' when the carbon content was 1% or more. The adherence of the external additive particles to the toner contained in developer 10 in developing unit 1 was evaluated by electron microscopic observation. This factor was determined as 'good' when the number of external additive particles adhering to the toner was as many as that before agitation; and it was determined as 'poor' when the number of external additive particles adhering to the toner was decreased by 30% or more compared to that before agitation or when external additive particles became embedded into the toner.

Figure 23:
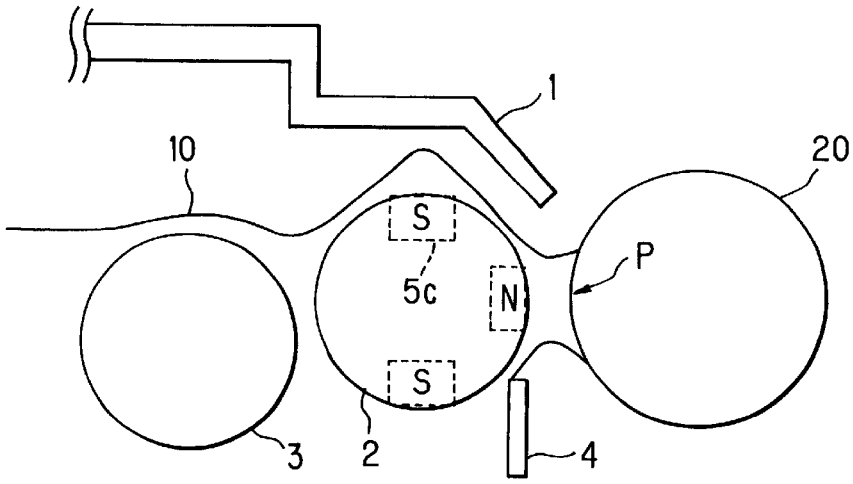
FIG. 23 is a sectional view showing the configuration of a developing unit of a first comparative example.
Figure 24:
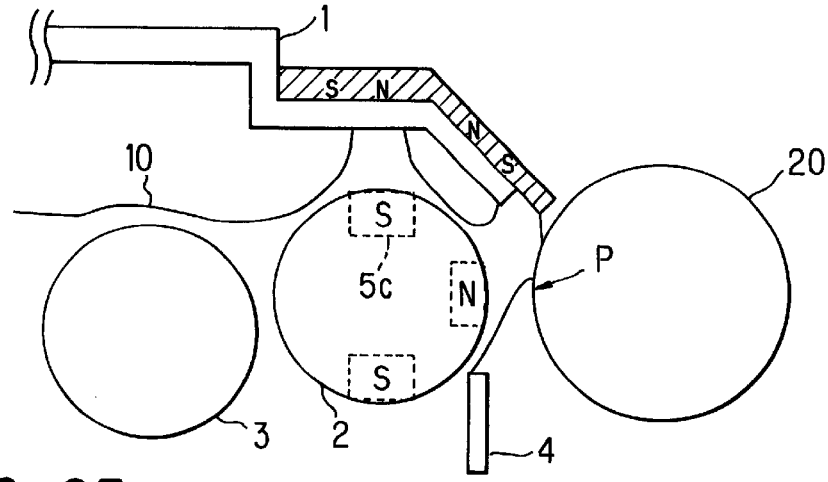
FIG. 24 is a sectional view showing the configuration of a developing unit of a second comparative example.
Figure 25:
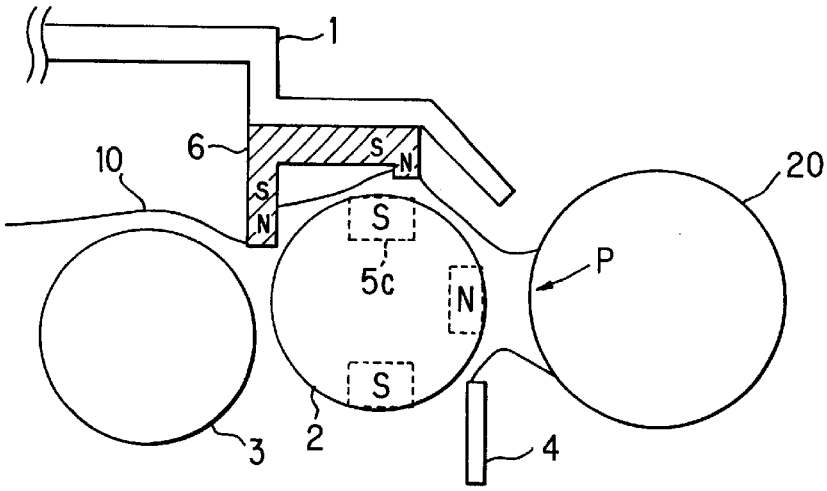
FIG. 25 is a sectional view showing the configuration of a developing unit of a third comparative example.

As apparent from FIG. 22, all the first through seventeenth examples of the invention presented beneficial results as to image density, fogging density, developer's circulation performance, toner aggregation, toner filming over the developing sleeve surface, toner filming over the carrier surface and adherence of external additives on the toner surface. On the contrary, the first comparative example (see FIG. 23) in which a developing unit 1 has no magnetic member 6, the second comparative example (see FIG. 24) in which a developing unit 1 has a magnetic member 6 exposed to the developing position P, and the third comparative example(see FIG. 25) in which a developing unit 1 has a magnetic member 6 directly in contact with the developer 10 in the developer conveyance path, all less than beneficial results as to all the evaluation items, i.e., image density, fogging density, developer's circulation performance, toner aggregation, toner filming over the developing sleeve surface, toner filming over the carrier surface and adherence of external additives on the toner surface.

From these results, it is possible to positively remove the developer from the peripheral surface of developing sleeve 2 and prevent the degradation of the developer whilst maintaining a beneficial image forming state, by arranging a magnetic member 6 at a position opposing the downstream side of the developing position P with respect to the rotational direction of developing sleeve 2, in the developer conveyance path formed by collecting magnetic pole 5*c* whilst being kept away from the developer 10 residing in the developer conveyance path.

It should be noted that this invention can also be applied to a developing unit using a mono-component developer consisting of a magnetic toner.

In accordance with the invention defined in the first feature, a magnetic member is arranged at a position opposing the developer conveyance path that is formed by the developer support, on the downstream side of the developing position with respect to the rotational direction of the developer support whilst being kept away from the developer in the developer conveyance path. Therefore, the developer residing in the developer conveyance path on the downstream side of the developing position with respect to the rotational direction of the developer support can be magnetized by the magnetism of the magnetic member in such a direction that the developer is attracted to the magnetic member side or in such a direction that the developer tends to repel the developer support, thus making it possible to weaken the attraction of the developer to the peripheral surface of the developer support and hence positively remove the developer from the peripheral surface of the developer support without imparting any mechanical stress on the developer adhering to the peripheral surface of the developer support. As a result, it is possible to maintain beneficial image forming conditions.

In accordance with the invention defined in the second feature, at least, a pair of magnetic pieces of polarities dissimilar from each other are arranged in the rotational direction of the developer support, at positions on the downstream side of the developing position with respect to the rotational direction of the developer support and opposing the magnetic field of the developer support whilst being kept away from the developer in the developer conveyance path so that the developer adhering to the peripheral surface of the rotating developer support is made to oppose the N and S magnetic poles, alternately. Accordingly, the magnetic fields of the magnetic pieces alternately magnetize the developer adhering to the peripheral surface of the developer support in a manner that alternately causes the developer to be attracted to the magnetic member side and to repel the developer support, thus making it possible to weaken the attraction of developer to the peripheral surface of the developer support, and hence positively remove the developer from the peripheral surface of the developer support without imparting any mechanical stress on the developer adhering to the peripheral surface of the developer support. As a result, it is possible to maintain beneficial image forming conditions.

In accordance with the invention defined in the third feature, an electromagnet of which the direction of the current can be switched by the current control circuit is arranged at a position on the downstream side of the developing position with respect to the rotational direction of the developer support and opposing the magnetic field of the developer support so that the developer adhering to the peripheral surface of the developer support is made to oppose the N and S magnetic poles, alternately. Accordingly, the magnetic fields created by the electromagnet alternately magnetize the developer adhering to the peripheral surface of the developer support in a manner that alternately causes the developer to be attracted to the magnetic member side and to repel the developer support, thus making it possible to weaken the attraction of the developer to the peripheral surface of the developer support, and hence positively remove the developer from the peripheral surface of the developer support without imparting any mechanical stress on the developer adhering to the peripheral surface of the developer support. As a result, it is possible to maintain beneficial image forming conditions.

In accordance with the invention defined in the fourth feature, a plural number of electromagnets are arranged at positions on the downstream side of the developing position with respect to the rotational direction of the developer support and opposing the magnetic field of the developer support, in the rotational direction of developer support so that the developer adhering to a large area on the peripheral surface of the rotating developer support is alternately magnetized so that the developer is attracted to the magnetic member side and repels the developer support, thus making it possible to weaken the attraction of the developer in the large area of the peripheral surface of the developer support, and hence positively remove the developer from the peripheral surface of the developer support.

In accordance with the invention defined in the fifth feature, a plural number of electromagnets producing magnetic fields of alternately, dissimilar polities are arranged at positions on the downstream side of the developing position with respect to the rotational direction of the developer support and opposing the magnetic field of the developer support, in the rotational direction of developer support so that the developer adhering to a large area on the peripheral surface of the rotating developer support is alternately magnetized so that the developer is attracted to the magnetic member side and repels the developer support, thus making it possible to further weaken the attraction of the developer in the large area of the peripheral surface of the developer support, and hence more positively remove the developer from the peripheral surface of the developer support.

In accordance with the invention defined in the sixth feature, a plural number of electromagnets configured of coils of alternating and opposite winding directions are arranged at positions on the downstream side of the developing position with respect to the rotational direction of the developer support and opposing the magnetic field of the developer support, in the rotational direction of the developer support. Therefore, adjacent electromagnets create magnetic fields of opposite polarities so that there is no need to individually switch the direction of current for each electromagnet thus making it possible to reduce the number of current control circuitry and hence reduce the cost.

In accordance with the invention defined in the seventh feature, the current to a single or each electromagnet that is arranged at a position on the downstream side of the developing position with respect to the rotational direction of the developer support and opposing the magnetic field of the developer support is varied in its direction or quantity in accordance with the used amount of the developer and/or the degraded level etc. As a result, it is possible to apply magnetism suitable for the developer adhering to the peripheral surface of the developer support, thus making it possible to positively remove the developer from the peripheral surface of the developer support without imparting any excessive mechanical stress on the developer.

In accordance with the invention defined in the eighth feature, the polarity of the magnetic field on the downstream side of the developing position with respect to the rotational direction of the developer support and opposing the peripheral surface of the developer support is changed periodically. Therefore, the developer adhering on the peripheral surface of the developer support can be periodically and uniformly magnetized throughout the entire peripheral surface of the developer support in a manner that alternately causes the developer adhering to the peripheral surface of the developer support to be attracted to the magnetic member side and to repel the developer support. As a result, it is possible to maintain the beneficial image forming conditions without producing any density unevenness in resulting images.

In accordance with the invention defined in the ninth feature, a rotational body having a magnetic pole or poles in part on the peripheral surface thereof is arranged at a position on the downstream side of the developing position with respect to the rotational direction of the developer support and opposing the peripheral surface of the developer support and is rotated at a fixed rate. Therefore, the magnetic pole or poles formed in part of the peripheral surface of the rotational body can be made to periodically oppose the peripheral surface of the developer support, and consequently it is possible to periodically magnetize the developer adhering to the peripheral surface of the developer support so as to cause the developer adhering to the peripheral surface of the developer support to be attracted to the magnetic member side and to repel the developer support, without the necessity of regulating the current at exactly controlled timings.

In accordance with the invention defined in the tenth feature, a rotational body having a plurality of magnetic poles arranged at regular intervals in the direction of the circumference on the peripheral surface thereof is arranged at a position on the downstream side of the developing position with respect to the rotational direction of the developer support so as to oppose the peripheral surface of the developer support. Therefore, it is possible to magnetize, in a further reduced cycle, the developer adhering to the peripheral surface of the developer support in such a direction as to be attracted to the magnetic member side or in such a direction as to repel the developer support. As a result, it is possible to further weaken the attraction of the developer to the peripheral surface of the developer support and further positively remove the developer from the peripheral surface of the developer support.

In accordance with the invention defined in the eleventh feature, a rotational body having a plurality of dissimilar, magnetic poles arranged alternately with respect to direction of the circumference on the peripheral surface thereof is arranged at a position on the downstream side of the developing position with respect to the rotational direction of the developer support so as to oppose the peripheral surface of the developer support. Therefore, it is possible to alternately magnetize, in a further reduced cycle, the developer adhering to the peripheral surface of the developer support in such directions as to be attracted to the magnetic member side and repel the developer support. As a result, it is possible to further weaken the attraction of the developer to the peripheral surface of the developer support and further positively remove the developer from the peripheral surface of the developer support.

What is claimed is:

1. A developing unit comprising:

a rotational, cylindrical developing sleeve which is axially supported at a position opposing a photosensitive member surface and having a plurality of fixed magnet members located inside the developing sleeve and generating magnetic fields at plural predetermined positions with respect to the rotational direction thereof in such a manner that spikes of developer are formed at a developing position on the surface of the developing sleeve so as to be brought into contact with the photosensitive member surface while not being formed on the upstream side and downstream side of the developing position with respect to the rotational direction thereof; and a magnetic member arranged at a location outside of the developer conveyance path adjacent the developing sleeve, and in proximity to one of said plurality of fixed magnetic numbers inside the sleeve on the downstream side of the developing position.

2. The developing unit according to claim 1, wherein the magnetic member has, at least, a pair of dissimilar magnetic poles arranged in the rotational direction of the developer support.

3. The developing unit according to claim 1, wherein the magnetic member comprises an electromagnet and further comprising a current control circuit for switching a current direction to the electromagnet.

4. The developing unit according to claim 3, wherein the magnetic member comprises a plurality of electromagnets arranged in the rotational direction of the developer support.

5. The developing unit according to claim 4, wherein the magnetic member comprises a plurality of electromagnets producing magnetic fields of alternately, dissimilar polarities.

6. The developing unit according to claim 5, wherein the plural electromagnets comprises coils of alternating and opposite winding directions.

7. The developing unit according to any one of claims 3–6, wherein the current control circuit varies a current or currents to a single or a plurality of electromagnets in direction or quantity, in accordance with the developer's operating conditions.

8. The developing unit according to claim 1, wherein the magnetic member periodically changes its polarity of the magnetic field opposing the peripheral surface of the developer support.

9. The developing unit according to claim 8, wherein the magnetic member is of a rotational body having a magnetic pole or poles disposed in part on the peripheral surface thereof and is arranged in parallel with the developer support.

10. The developing unit according to claim 8, wherein the magnetic member is of a rotational body having a plurality of magnetic poles arranged at regular intervals in the direction of the circumference on the peripheral surface thereof.

11. The developing unit according to claim 10, wherein the magnetic member is of a rotational body having a plurality of dissimilar, magnetic poles arranged alternately with respect to direction of the circumference on the peripheral surface thereof.

12. The developing unit according to claim 1, wherein the fixed magnet members located inside the developing sleeve include:

a developing pole located at a position opposite the developing position;

a conveying pole located on the upstream side of the developing position for conveying developer to the developing position;

a collecting pole located on the downstream side of the developing position for collecting developer from the peripheral surface of the developing sleeve; and wherein the magnetic member is located at a position opposite the collecting pole.

* * * * *